US007386252B2

(12) United States Patent
Portig et al.

(10) Patent No.: US 7,386,252 B2
(45) Date of Patent: Jun. 10, 2008

(54) DOOR PANEL INTERLOCKS FOR AN IMAGE FORMING DEVICE

(75) Inventors: Harald Portig, Versailles, KY (US); Larry Steven Foster, Lexington, KY (US); Brian Allen Blair, Richmond, KY (US); David Erwin Rennick, Georgetown, KY (US); Jeffrey Lawrence Tonges, Versailles, KY (US); Robert Galon Newman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 337 days.

(21) Appl. No.: 11/286,671

(22) Filed: Nov. 23, 2005

(65) Prior Publication Data

US 2007/0116506 A1 May 24, 2007

(51) Int. Cl.
*G03G 21/16* (2006.01)
*G03G 15/00* (2006.01)

(52) U.S. Cl. ..... 399/110; 399/124

(58) Field of Classification Search ..... 399/124, 399/110; 49/141, 197–199
See application file for complete search history.

(56) References Cited

U.S. PATENT DOCUMENTS 6,148,897 A * 11/2000 Horner et al. ..... 49/197
6,321,822 B1 * 11/2001 Horner et al. ..... 49/197
6,901,703 B2 * 6/2005 Langenbach ..... 49/197
7,076,187 B2 * 7/2006 Jeong et al. ..... 399/110
2005/0076570 A1 * 4/2005 Delgado et al. ..... 49/141
2006/0120756 A1 * 6/2006 Ahn et al. ..... 399/124
2007/0048004 A1 * 3/2007 Murrell ..... 399/110

* cited by examiner

*Primary Examiner*—Susan S Lee
(74) *Attorney, Agent, or Firm*—Coats & Bennett, PLLC

(57) ABSTRACT

An image forming device includes a body and one or more door assemblies. At least one door assembly may be movable between open and closed orientations. A variety of mechanical and electrical interlocks may be used to control motion of the door assemblies. A first interlock may prevent a door assembly from moving under the influence of a force between an open and closed orientation prior to a condition being satisfied. This condition may depend on the position of a second door assembly. A breakaway feature may release the first interlock when the closing force exceeds a predetermined level. A second interlock may work with the first interlock to keep a second door assembly from opening if the first door assembly is closed. An electrical interlock may disconnect power to the image forming device when the first door assembly is open.

21 Claims, 21 Drawing Sheets

DOOR PANEL INTERLOCKS FOR AN IMAGE FORMING DEVICE

BACKGROUND

Image forming devices often have modular designs comprising a plurality of consumer replaceable units (CRUs). Some example CRUs include waste toner cartridges, developer cartridges, photoconductive members, and transport belt modules. Some of these CRUs are consumable items that are used or worn with use. Over the life of an image forming unit, these CRUs may be replaced multiple times. Replacing the CRUs typically requires access to the interior of the image forming unit.

Replacement and mounting of these modules is vital to acceptable user ergonomics. The modules should be positioned in a manner to be accessible to the user. The complex design of many current devices makes accessing the components difficult. The modules may be located within the interior of the device making it very difficult to grasp and manipulate the modules. Intricate cartridge mounting locations may also result in toner spills and component damage, which may result in print defects, or the device not operating properly.

In addition to replacing CRUs, there may be other times when it is necessary to access the interior of an image forming device. For instance, paper jam errors sometimes require access to interior portions of a paper feed path to clear misfeeds. To that end, image forming devices are often provided with exterior door panels. These door panels often comprise some portion of the exterior housing of the image forming device and may be opened and closed as needed to access the interior of the device.

As image forming devices become smaller in size, rigid space constraints may limit placement options for internal components, including CRUs. In some cases, it may be advantageous to include multiple door panels to improve access to the interior of the image forming device. For example, in some cases, a first door may provide access to a paper path to clear paper jams while a second door may permit removal of CRUs. In these cases, one door panel may need to be opened before opening another. By the same token, the door panels may also need to be closed in a particular order. This may be particularly true if opening one of the door panels triggers a series of events, such as disengaging rotary drive components. Thus, if these door panels are not opened or closed in the proper order, device errors may ensue. Worse yet, damage to the moving components, hinges, or latch mechanisms may result, thus causing device downtime and/or expensive repairs.

SUMMARY

Embodiments of the present invention are directed to an image forming device and methods of controlling and interlocking door assembly movement and device operation. These features may be implemented in an image forming device having a body and one or more door assemblies. A variety of mechanical and electrical interlocks may be used to control motion of the door assemblies. In certain embodiments, some of the image forming device modules may be mounted to one or more of the door assemblies.

At least a first door assembly may be movably coupled to the body and positionable between a first open orientation where the first door assembly is positioned away from the body and a first closed orientation where the first door assembly is positioned in proximity to the body. A first interlock may prevent an undesired first door assembly motion. For instance, the first door assembly motion may be when the first door assembly moves under the influence of a force between the first open orientation and the first closed orientation prior to a condition being satisfied. An exemplary condition may be when a second door assembly is positioned in a second open orientation away from the body. A breakaway feature may be included to release the first interlock when the force exceeds a predetermined level. The breakaway feature may reset the first interlock if the second door assembly is moved from the second open orientation to a second closed orientation in proximity to the body. Alternatively, the breakaway feature may reset the first interlock if the first door assembly is moved from the first closed orientation back to the first open orientation.

A second interlock may cooperate with the first interlock to obstruct the second door assembly from moving to the second open orientation if the first door assembly is in the first closed orientation. In one embodiment, the second interlock may unconditionally allow the first door assembly to move between the first open orientation and the first closed orientation.

The image forming device may also have an electrical interlock to disconnect power to the image forming device when the first door assembly is positioned in the first open orientation. Conversely, the electrical interlock may supply power to the image forming device when the first door assembly is positioned in first closed orientation. An exception may be that the electrical interlock continues to remove power if the breakaway feature has released the first interlock.

DETAILED DESCRIPTION

Figure 1A:
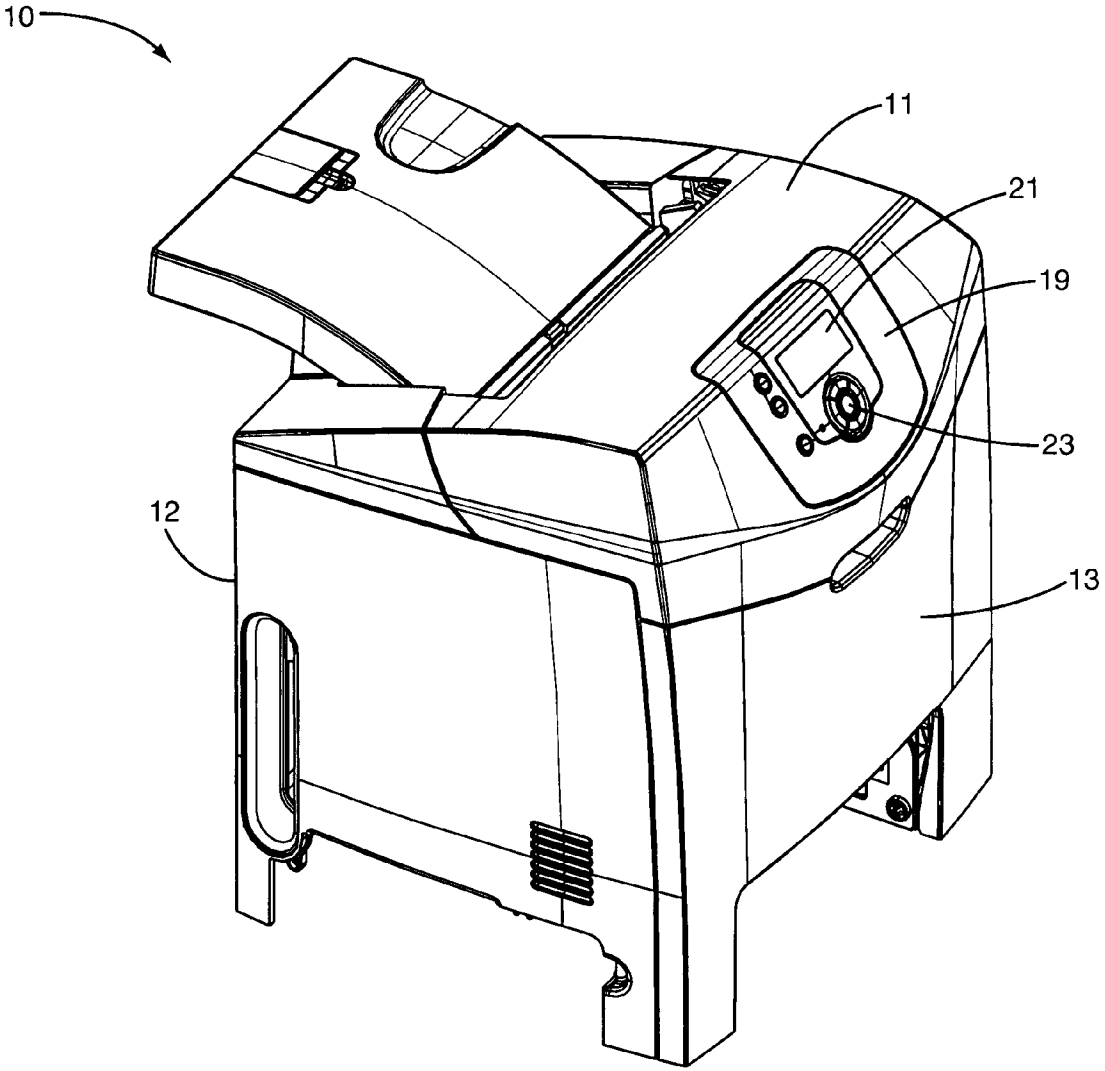
FIGS. 1A-1C are schematic diagrams of an image forming device having a plurality of moveable door assemblies according to one embodiment of the present invention.

The various embodiments disclosed herein are directed to controlling the order in which door panels of an image forming device are opened and closed. The mechanisms implemented also feature a breakaway mechanism that prevents damage to the image forming device. Also disclosed is a safety interlock that removes and reapplies system power if the door panels are opened and closed in the appropriate order. The various embodiments may be implemented in an image forming device of the type indicated generally by the numeral 10 in FIGS. 1A-1C. The exemplary image forming device 10 comprises a main body 12 and two door assemblies 11, 13. As used herein, the term "door assembly" is intended to refer to a door panel that is movably or detachably coupled to the main body 12. Exemplary door assemblies 11, 13 may simply comprise a door panel and any mounting hardware that permits relative movement between the main body 12, including but not limited to hinges and link arms or pivot arms. As indicated below, other components may be coupled to the door assemblies 11, 13. The first door assembly 11 is located towards a top side of the image forming device 10 while the second door assembly 13 is located towards a lateral side of the image forming device 10. In the exemplary image forming device 10, a user interface panel 19 comprising a display 21 and one or more input buttons 23 is disposed on the first door assembly 11.

Figure 1B:
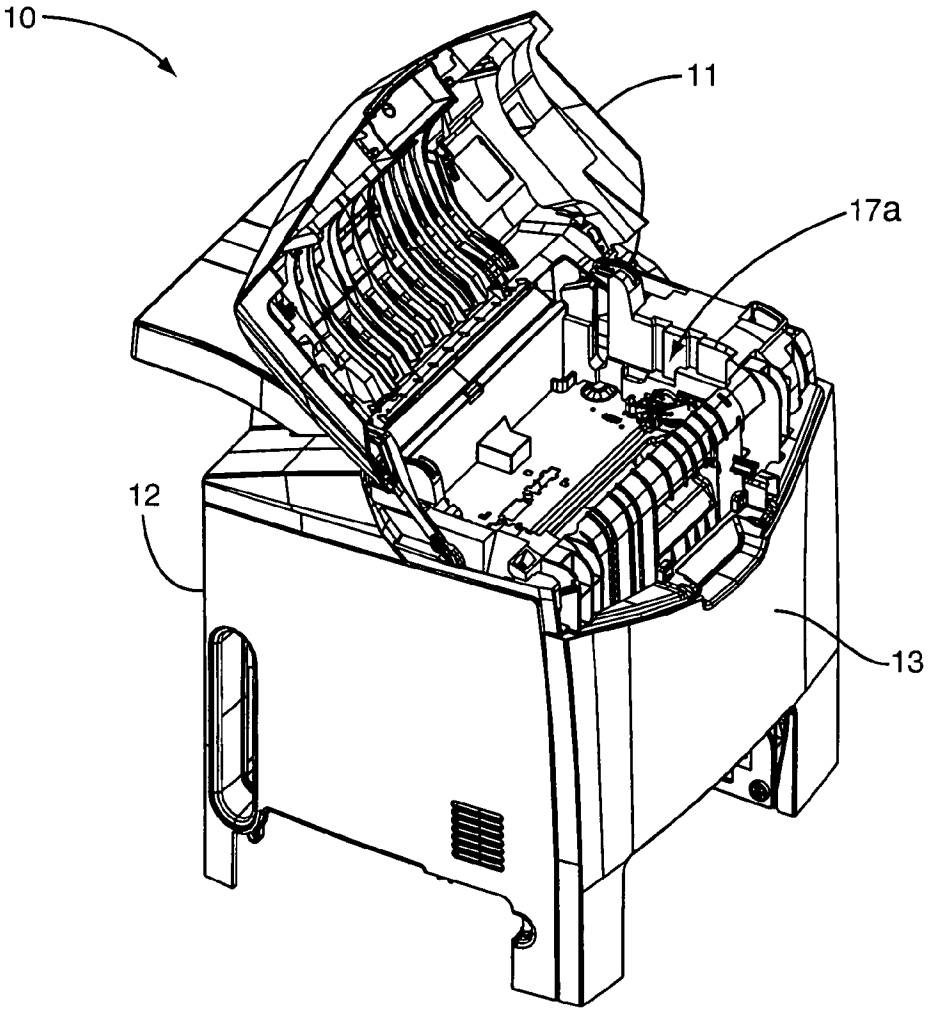
Figure 1C:
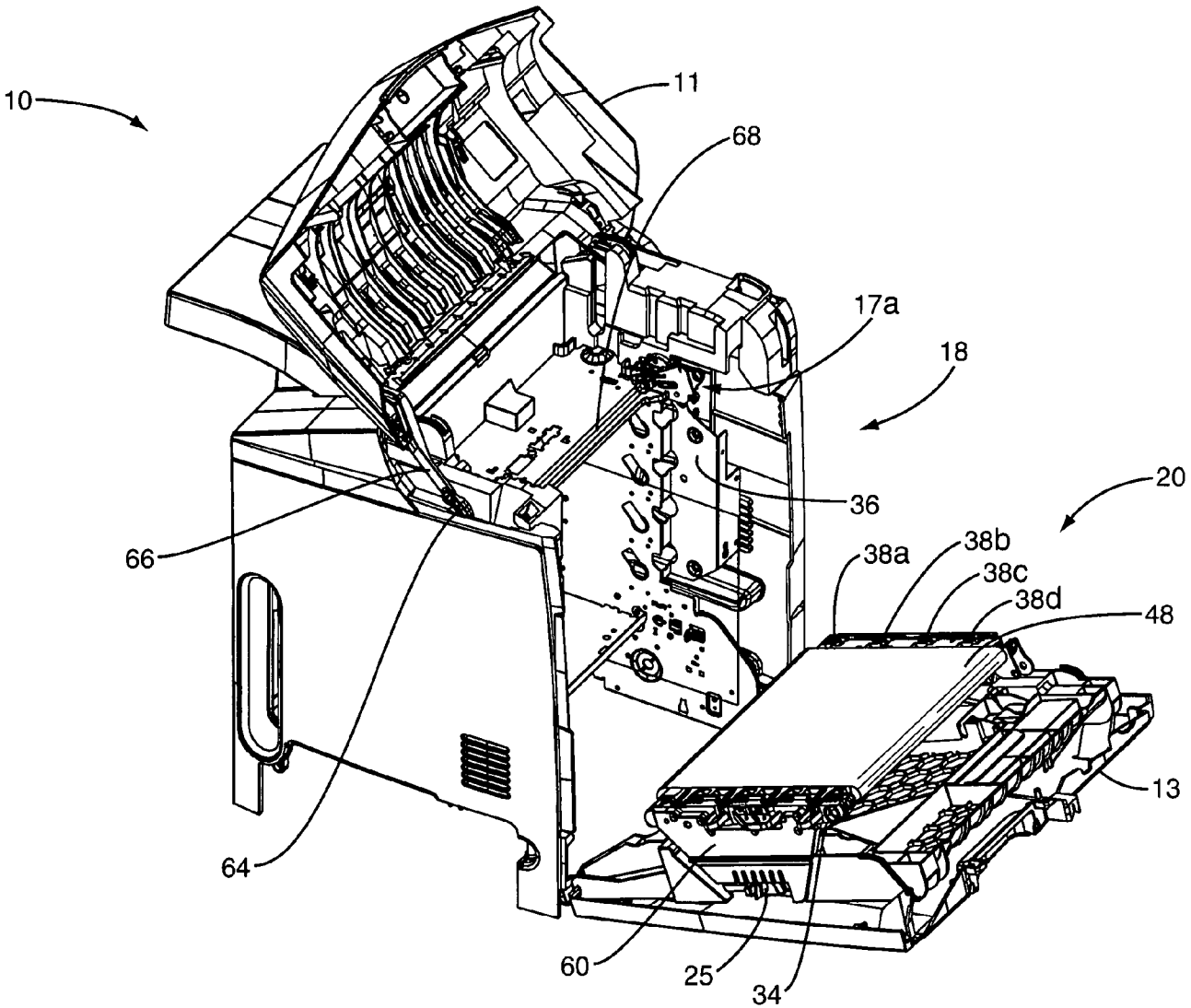

Each door assembly 11, 13 is movable between a closed position as shown in FIG. 1A and an open position as shown in FIGS. 1B and 1C. In the exemplary embodiment, the door assemblies are opened in the order illustrated by the progression from FIG. 1A to FIG. 1B to FIG. 1C. That is, access to the interior of the image forming device 10 may be provided by first opening the first door assembly 11 followed by the second door assembly 13. The door assemblies 11, 13 are returned to the operating position in the reverse order. That is, the second door assembly 13 is closed before the first door assembly 11.

One or more modules may be coupled to the first and second door assemblies 11, 13. For instance, FIG. 1C shows a belt module 20 coupled to the second door assembly 13. The belt module 20 may be an image transfer belt, a document transport belt, or other belt commonly used in image forming devices 10. The schematic illustration provided in FIG. 2 shows one embodiment of an image forming device 10 where belt module 20 is implemented as a transport belt module.

Figure 2:
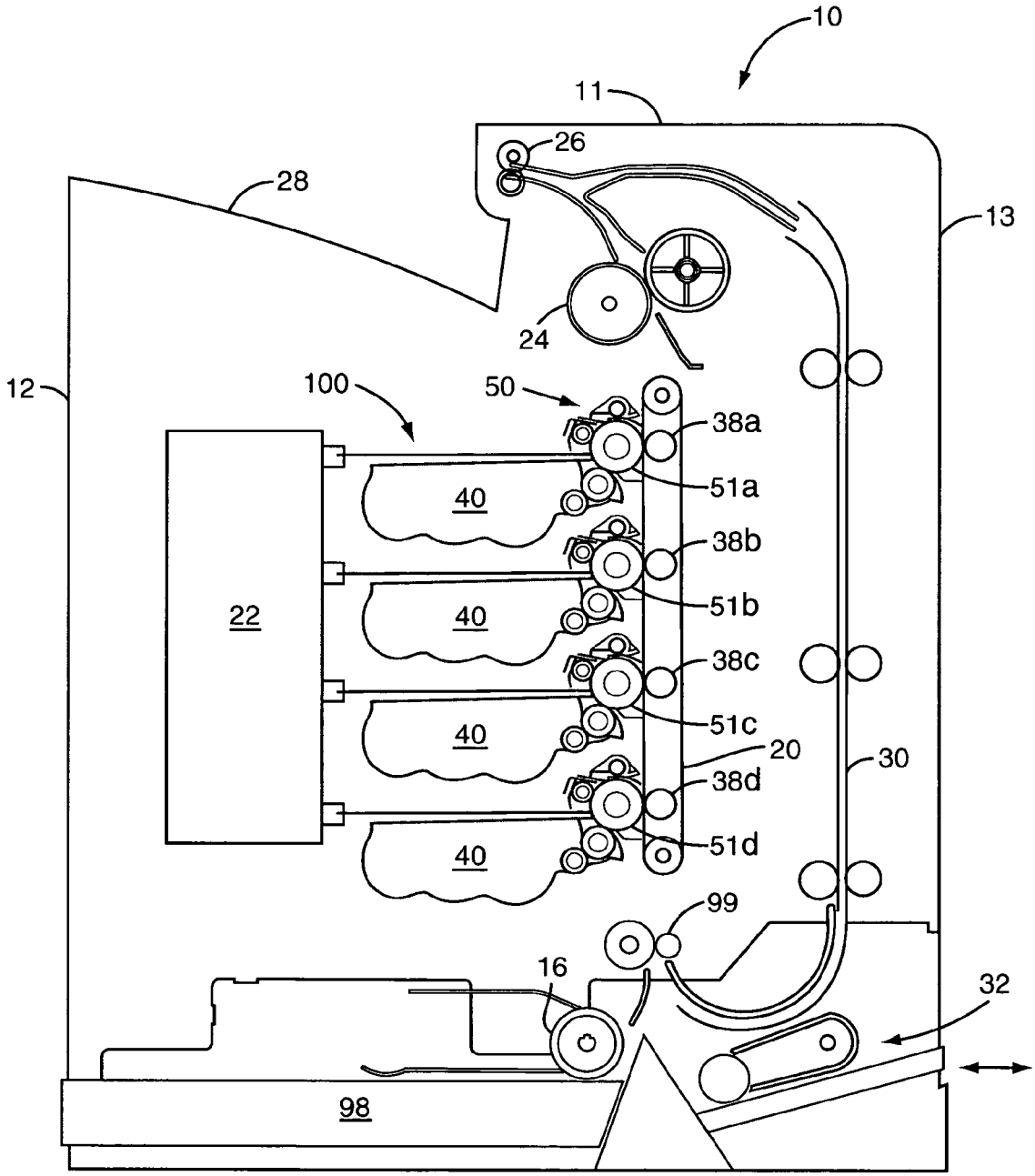
FIG. 2 is a functional diagram of an image forming apparatus according to one embodiment of the present invention.

A schematic representation of the exemplary image forming device 10 is shown in FIG. 2. The image forming device 10 includes a media tray 98 with a pick mechanism 16 and a multi-purpose feeder 32, both of which are conduits for introducing media sheets into the device 10. The media tray 98 is preferably removable for refilling, and located on a lower section of the device 10. Media sheets are moved from the input and fed into a primary media path. One or more registration rollers 99 disposed along the media path aligns the print media and precisely controls its further movement along the media path. The belt module 20 forms a section of the media path for moving the media sheets past a plurality of image forming units 100. Color printers typically include four image forming units 100 for printing with cyan, magenta, yellow, and black toner to produce a four-color image on the media sheet.

An optical scanning device 22 forms a latent image on photoconductive members 51*a-d* within the image forming units 100. Toner from the developer units 40 is supplied to develop the respective latent images. The developed images are then transferred from the photoconductive members 51*a-d* to the media sheet being transported by the belt module 20. The media sheet with loose toner is then moved through a fuser 24 that adheres the toner to the media sheet. Exit rollers 26 rotate in a forward direction to move the media sheet to an output tray 28. Optionally, the rollers 26 may rotate in a reverse direction to move the media sheet to a duplex path 30. The duplex path 30 directs the inverted media sheet back through the image formation process for forming an image on a second side of the media sheet.

Figure 3:
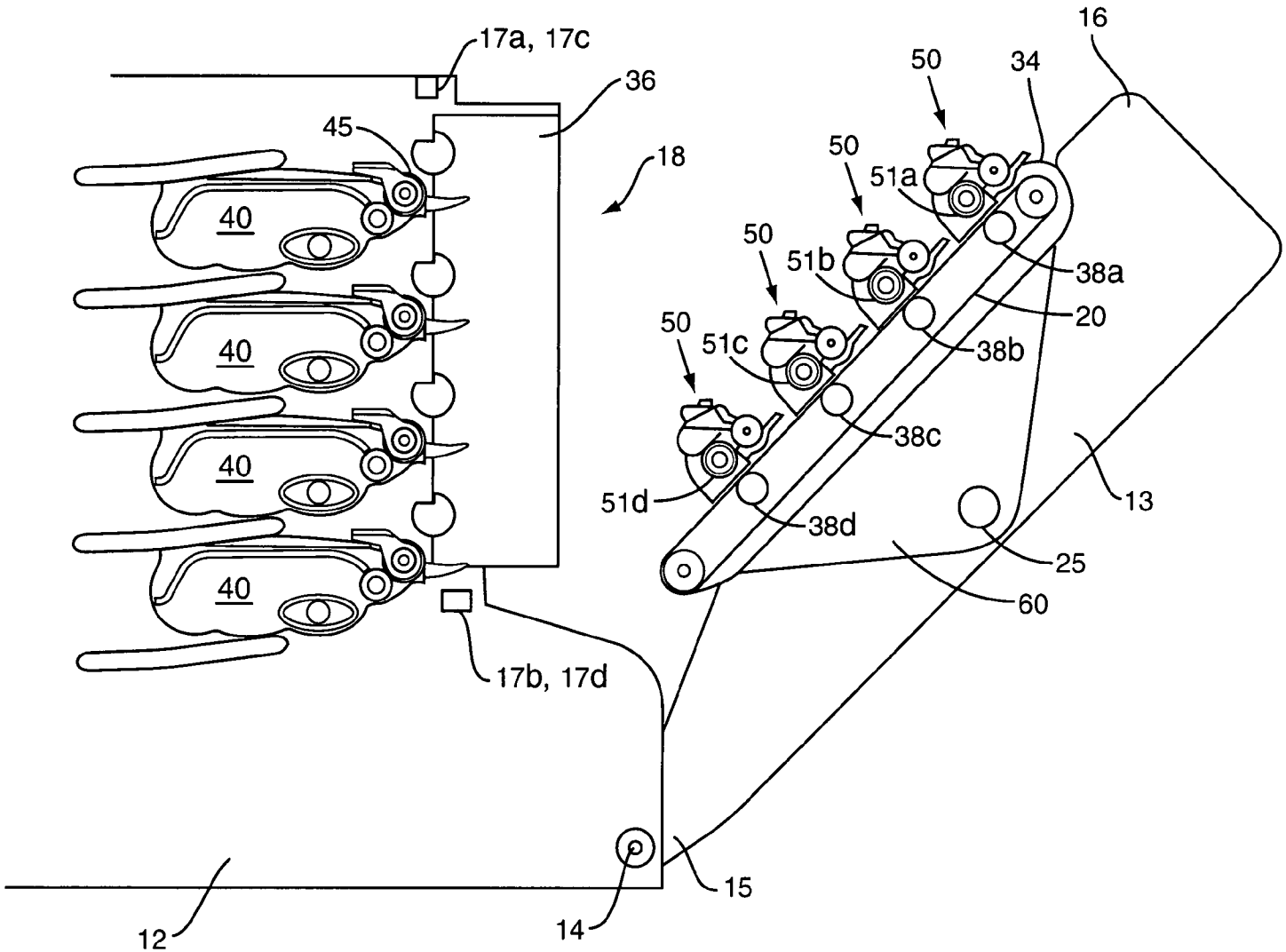
FIG. 3 is a is a cut-away side view of an image forming device with a door assembly in an open orientation according to one embodiment of the present invention.

As indicated above, at least one internal module may be attached to the second door assembly 13 and travel with the second door assembly 13 as it moves between an open and closed position. FIG. 1C shows at least a belt module 20 being coupled to the second door assembly 13. Other modules may be coupled to the second door assembly as well. For example, some portion or the entire image forming unit 100 may be coupled to the second door assembly 13. FIGS. 2 and 3 show exemplary image forming units 100 that are constructed of a separate developer unit 40 and a photoconductor unit 50. The developer unit 40, including a developer member 45, may be positioned within the main body 12 whereas the photoconductor unit 50 may be mounted to the second door assembly 13 along with the aforementioned belt module 20. In a closed orientation as illustrated in FIGS. 1A and 2, the second door assembly 13 is positioned adjacent to the main body 12 with the photoconductive member 51 of the photoconductor unit 50 positioned adjacent the developer unit 40. In an open orientation as illustrated in FIG. 3, the second door assembly 13 is moved away from the main body 12 separating the photoconductor unit 50 and belt module 20 from the developer unit 40. This configuration provides direct and easy user access to the developer unit 40, photoconductor unit 50, and the belt module 20. It has been determined that the highest user intervention rates are at the developer unit 40, photoconductor unit 50, and media path in the vicinity of the belt module 20.

As illustrated in FIGS. 1C and 3, the main body 12 has enclosed sides forming an opening 18 for mounting the developer units 40. Developer units 40 are positioned within the opening 18 with the developer roll 45 extending outward to contact the photoconductive member 51 during image formation. Opening 18 may be sized to encompass the entire side of the main body 12, or may comprise only a limited portion of one side. In the embodiment of FIG. 3, opening 18 is positioned on a lateral side of the main body 12. Opening 18 may also be positioned on the top or bottom side of the main body 12 depending upon the application. For instance, in image forming devices 10 that orient the image forming units 100 in a more horizontal configuration, the opening 18 may be advantageously placed towards a top side of the main body 12.

The second door assembly 13 is movably attached relative to the main body 12 between an opened orientation as illustrated in FIGS. 1C and 3 and a closed orientation as illustrated in FIGS. 1A and 2. The second door assembly 13 may be attached to the main body 12 in a variety of manners. FIG. 3 illustrates one embodiment with the second door assembly 13 pivotally attached to the main body 12 through a pivot 14. Pivot 14 may attach the main body 12 and second door assembly 13 at a variety of locations, such as towards a lower edge 15. In the open orientation, the door assembly upper edge 16 is spaced from the main body 12. This orientation provides access to the developer units 40, photoconductor units 50, and media path, including belt module 20. In the closed orientation, the upper edge 16 is in proximity to the main body 12. The upper edge 16 may be in contact with the main body 12, or slightly spaced apart from the main body 12.

Referring to FIGS. 1C and 3, the belt module 20 is coupled, at least loosely, to second door assembly 13. FIG. 3 further shows the photoconductor units 50 coupled to the door assembly 13. The photoconductor units 50 are omitted from FIG. 1C for clarity. A roller frame 34 is coupled to the door assembly 13 and configured so that rollers 38*a*-38*d* substantially span the width of belt module 20. An endless belt 48 extends around the rollers 38*a*-38*d*. In one embodiment, the rollers 38*a*-38*d* are transfer rollers that are electrically biased to promote the transfer of a developed image from an associated photoconductive member 51 to a media sheet being carried by the belt 48. Alternatively, the endless belt 48 may be an image transfer belt and developed images may be transferred to the endless belt 48 for subsequent transfer to a media sheet.

The roller frame 34 is attached to a subframe 60 that is pivotally attached to the second door assembly 13 at a second pivot 25. The second pivot 25 allows the subframe 60 to move relative to the second door assembly 13 when the second door assembly 13 is in the open orientation. In the closed orientation, the roller frame 34 and subframe 60 are accurately aligned with the main body 12 such that the photoconductive members 51 are aligned with the developer rolls 45. One or more locks 17 maintain the second door assembly 13 in the closed orientation and secure the roller frame 34 and subframe 60 in this aligned position when the second door assembly 13 is in the closed orientation. In one embodiment, a total of four locks 17 connect the roller frame 34, subframe 60, and second door assembly 13 to the main body 12. As shown in FIG. 3, the two upper locks are designated 17*a*, 17*c*, while the two lower locks are designated 17*b*, 17*d*. The following discussion focuses primarily on the upper locks 17*a*, 17*c*. Thus, for the sake of clarity in the following discussion, lock 17*a* will be referred to as the upper right lock. The upper right lock 17*a* is depicted in FIG. 1C. The nomenclature "upper right" is derived from the fact that the lock is positioned at the upper right corner of the opening 18 when looking into the opening from the right side of FIGS. 1C and 3. Similarly, the other upper lock 17*c* located at the upper left corner of opening 18 (not visible in FIG. 1) is designated as the upper left lock 17*c*. These left/right distinctions are offered merely for the sake of clarity and should not be construed as limiting. The locking and interlock features described below may be implemented in any of a right side, left side, top side, or bottom side of a door panel opening.

Figure 4:
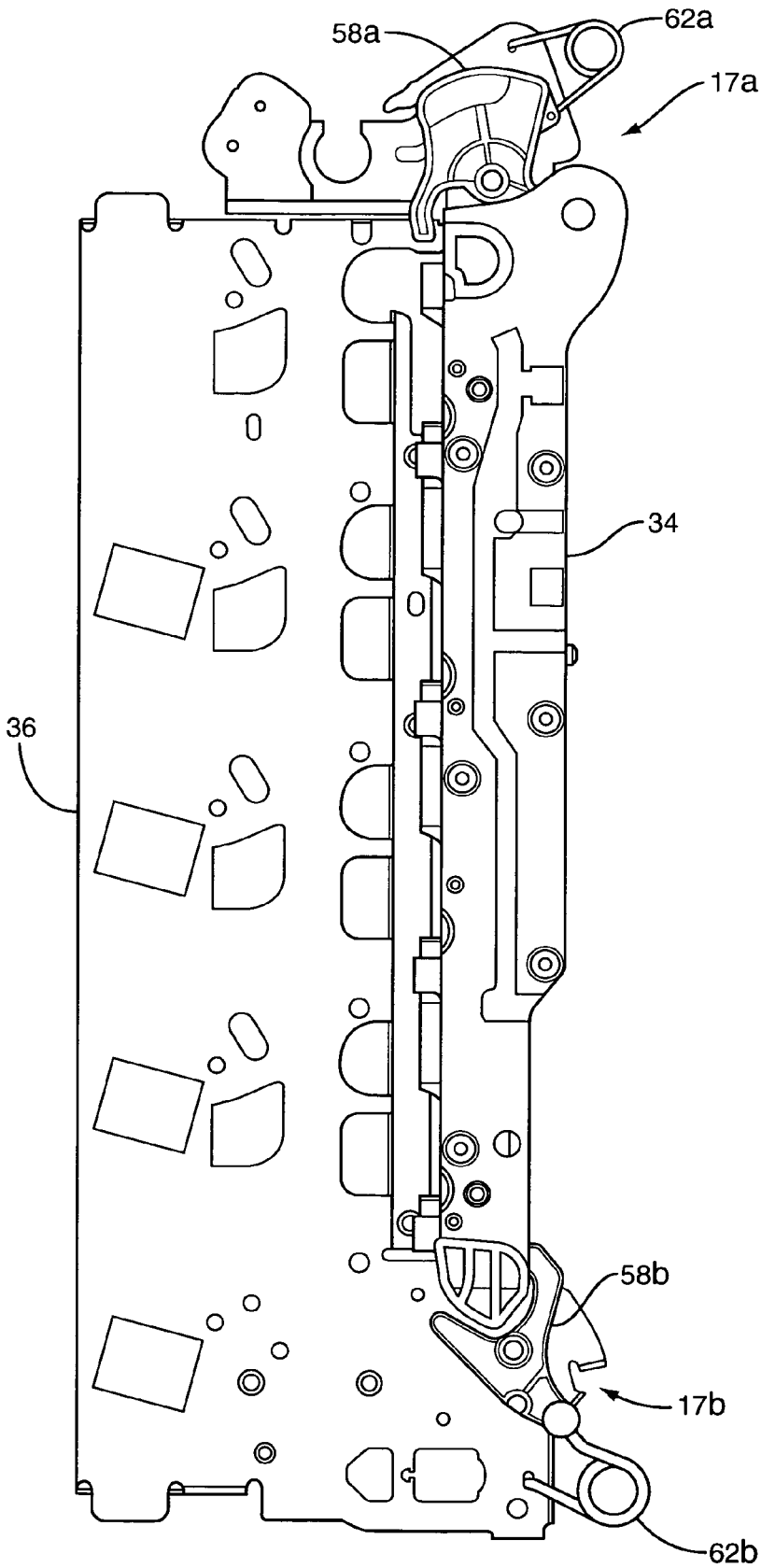
FIG. 4 is a partial side view of locking members used to secure a door assembly according to one embodiment of the present invention.

FIG. 4 illustrates a more detailed representation of locks 17*a*, 17*b* located at the right side of door opening 18. Specifically, FIG. 4 shows the upper right lock 17*a* and the lower right lock 17*b* used to secure the right side of roller frame 34 to an interior frame 36. The interior frame 36 is disposed within the interior of the image forming device housing 12. The remaining portions of the image forming device 10, including image forming units 100, and second door assembly 13 are omitted from FIG. 4 for clarity. The roller frame 34 is depicted in the closed orientation in FIG. 4. The upper right lock 17*a* and lower right lock 17*b* are depicted in a locked orientation, thereby securing the roller frame 34 in this closed orientation.

Figure 5A:
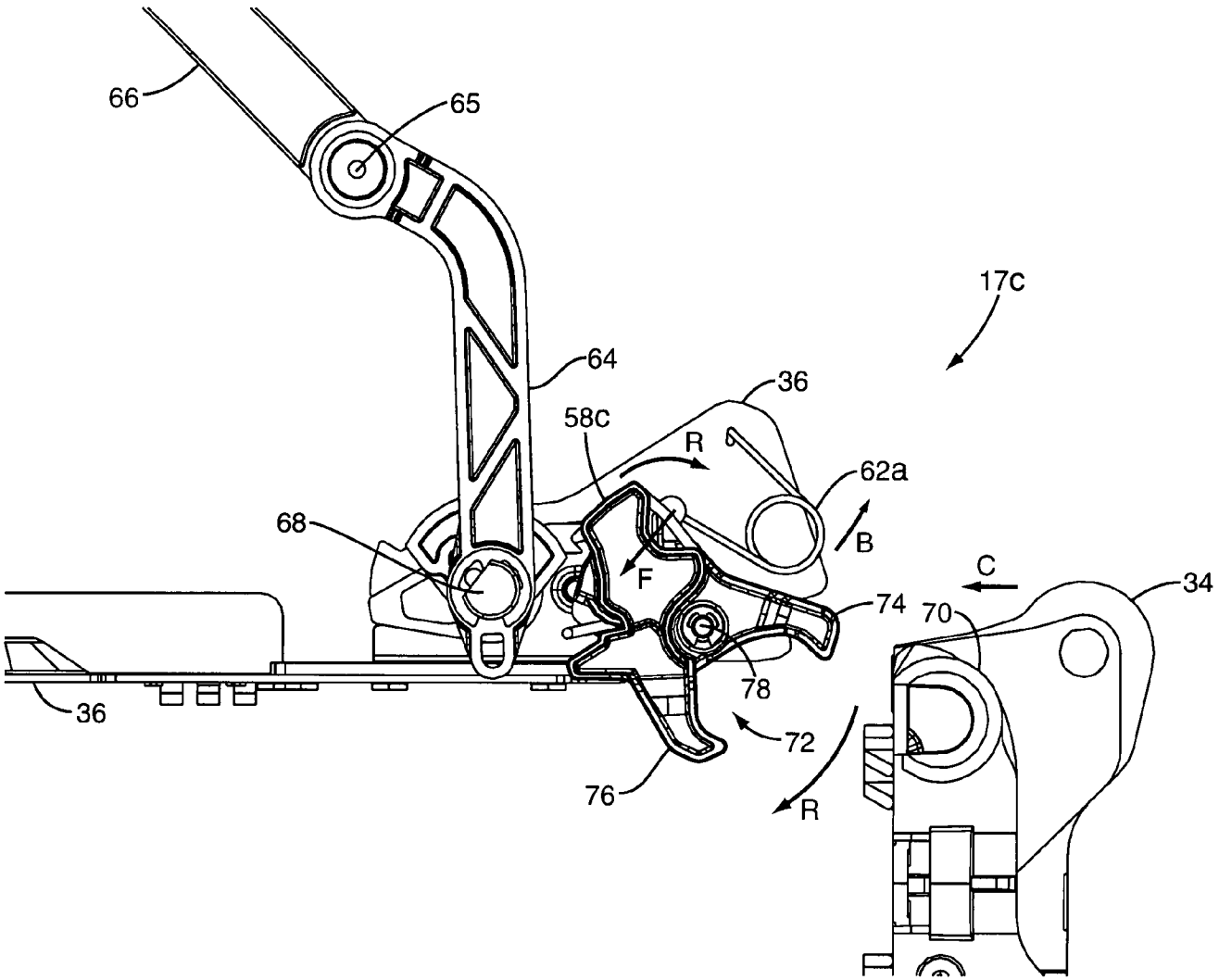
FIGS. 5A-5C are schematic diagrams showing a sequence by which a locking member secures a door assembly according to one embodiment of the present invention.
Figure 5B:
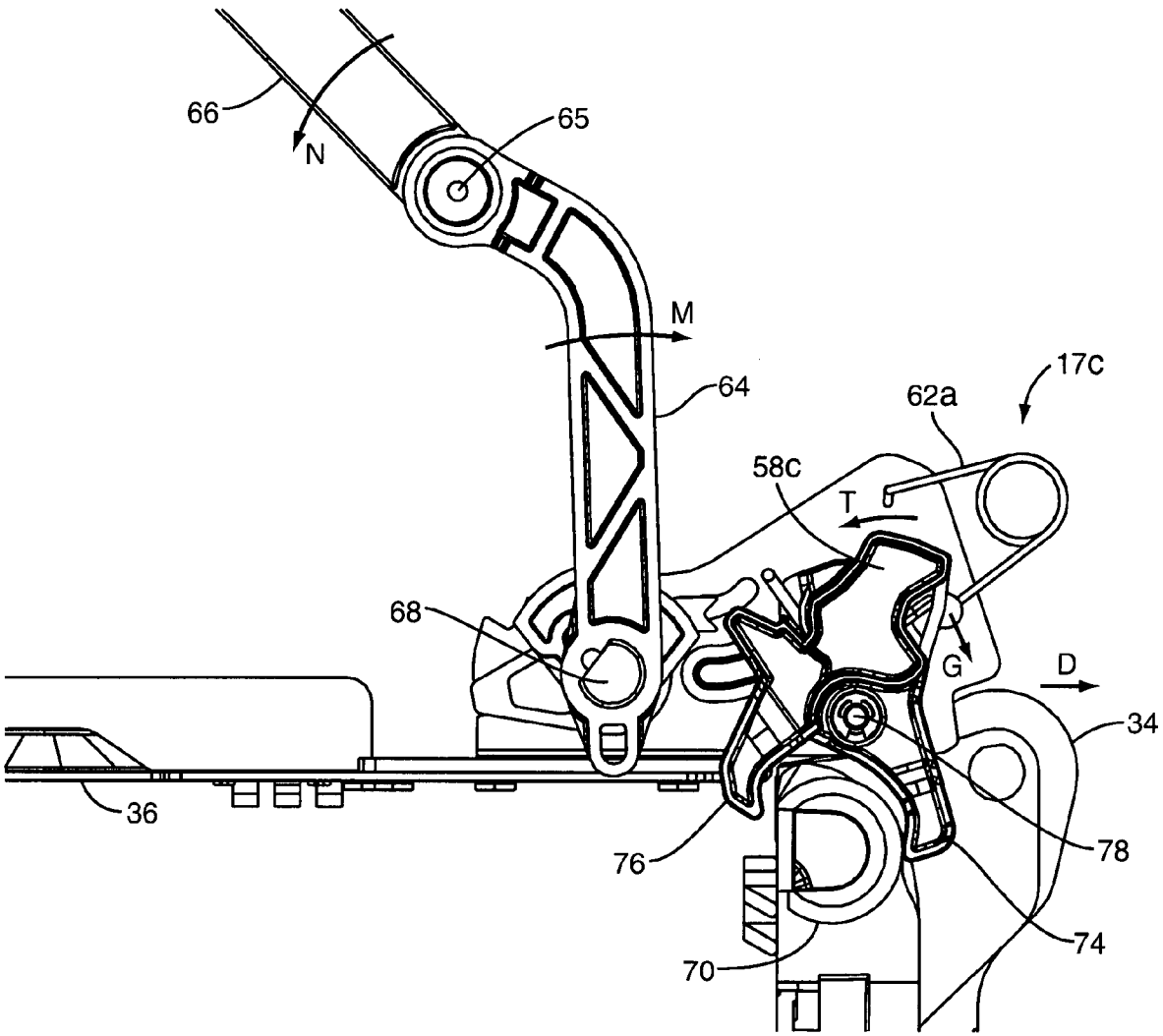
Figure 5C:
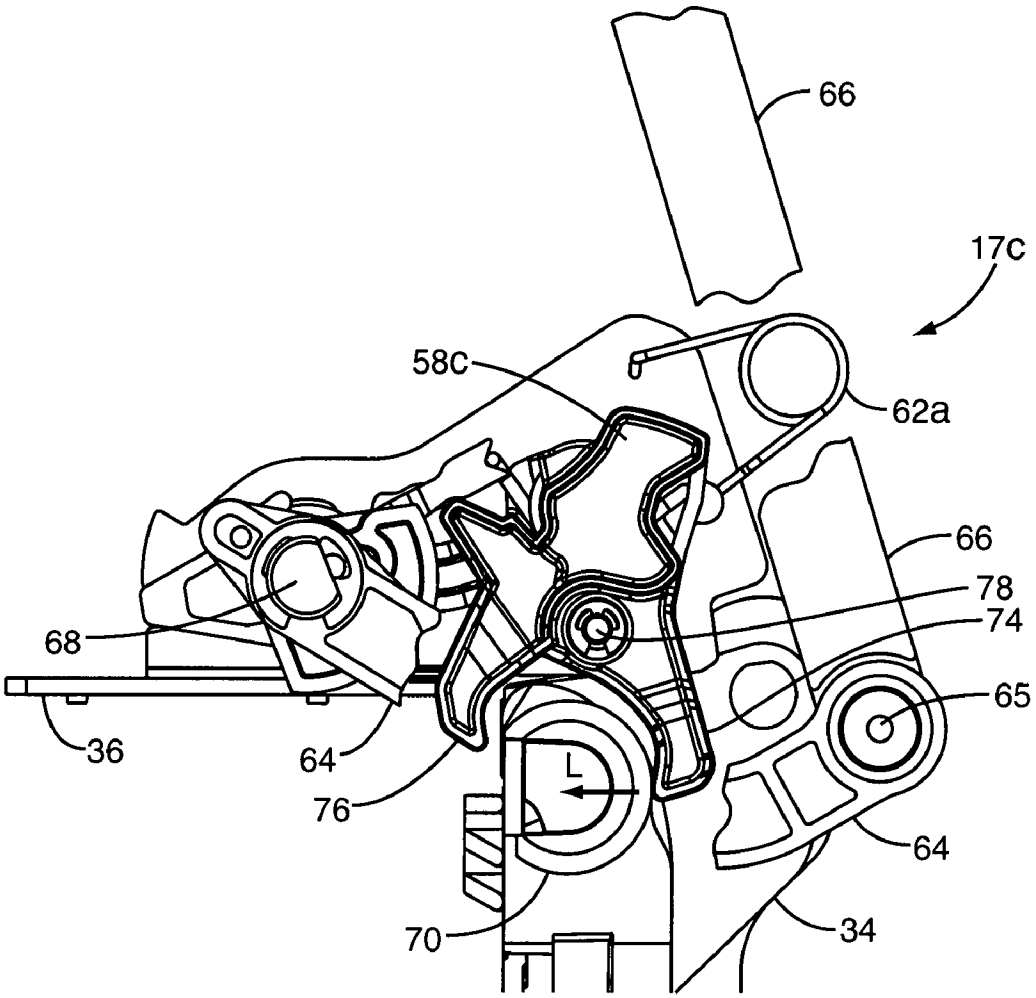

In one embodiment, the upper right lock 17*a* and lower right lock 17*b* comprise over-center clamps 58*a* and 58*b*, respectively, that are pushed over center by motion of the roller frame 34 when the second door assembly 13 is opened and closed. The upper right lock 17*a* includes a first biasing member 62*a* that provides some nominal first securing force when the roller frame 34 is moved from the open orientation to the closed orientation as shown in FIG. 4. Lower right lock 17*b* also includes a corresponding biasing member 62*b* that performs a similar function. Biasing members 62*a* and 62*b* are selected to limit the amount of user force that is required to move the second door assembly 13 and roller frame 34 into the closed position. Notably, the upper left lock 17*c* and lower left lock 17*d* (not visible in FIG. 4) also include corresponding biasing members 62*a* and 62*b*. Additional securing force may be provided by the locks 17*a*-*d* by actuating a locking sequence exemplified in FIGS. 5A-5C. This sequence is initiated by first closing second door assembly 13 and completed by closing the first door assembly 11. FIGS. 5A-5C illustrate this locking sequence for only one of the four locks (i.e., the upper left lock 17*c*). The lower locks 17*b*, 17*d* operate in a manner similar to upper locks 17*a*, 17*c* and a detailed description thereof is not provided herein. Note also that the illustration provided in FIG. 5C shows cutaway portions of a first pivot arm 64 and a second pivot arm 66 to reveal the other components of the upper left lock 17*c*.

FIGS. 5A-5C illustrate relevant parts of the image forming device 10 involved in securing the roller frame 34 and door assembly 13 in a closed position. The upper left lock 17*c* is coupled to interior frame 36 similar to the upper right lock 17*a* as described above and as shown in FIG. 4. FIGS. 5A-5C also show a first pivot arm 64 and a second pivot arm 66 that are coupled to the first door assembly 11. The first pivot arm 64 and second pivot arm 66 are also visible (on the near side) in FIG. 1C. FIGS. 1C and 5A-5C also show a shaft 68 that rotates in conjunction with the motion of first pivot arm 64 and second pivot arm 66. A more detailed description of the movement of pivot arms 64, 66 and shaft 68 is provided below.

The progression from FIG. 5A to FIG. 5B to FIG. 5C shows a locking sequence that provides an adequate securing force to hold the roller frame 34 in the closed position while minimizing the amount of user input force needed to initiate the illustrated motions. Initially, as shown in FIG. 5A, the roller frame 34 is in an open orientation and is spaced away from the upper left lock 17*c*. As the second door assembly 13 and roller frame 34 are pushed into a closed orientation (in the direction indicated by arrow C in FIG. 5A), a protrusion 70 on the roller frame 34 engages a gap 72 between a first clamp arm 74 and a second clamp arm 76. The contact between the protrusion 70 and the second clamp arm 76 causes the clamp 58*c* to rotate about a clamp pivot 78 in the direction indicated by the arrow labeled R.

In the embodiment shown, the first biasing member 62*a* is implemented as a torsion spring. The rotation of clamp 58*c* is resisted by a bias force F applied by the first biasing member 62*a*. As the clamp 58*c* rotates in the direction indicated by the arrow labeled R, the first biasing member 62*a* moves upward in the direction indicated by the arrow labeled B. Ultimately, the roller frame 34, the clamp 58*c*, and first biasing member 62*a* move to the position shown in FIG. 5B.

The remaining locking force is actuated as the first door assembly 11 is closed. This motion is illustrated in the sequence from FIG. 5B to 5C. When the first door assembly 11 is closed, the first pivot arm 64 and the second pivot arm 66 rotate in the directions indicated by the arrows labeled M and N in FIG. 6B, respectively. Note that the first pivot arm 64 and the second pivot arm 66 rotate relative to one another about an arm pivot 65. The crank shaft 68 has a substantially D-shaped cross section that fits within a similarly shaped aperture within the first pivot arm 64. Thus, the rotational motion imparted on the first pivot arm 64 by the second pivot arm 66 and the first door assembly 11 is transmitted to the crank shaft 68. An over-center clamping mechanism is actuated by the rotation of the crank shaft 68. Thus, when the first door assembly 11 is completely closed, a locking force L is applied by the first clamp arm 74 on the protrusion 70. A more thorough description of the over-center locking mechanism used in upper locks 17*a* and 17*c* is provided in commonly assigned U.S. patent application Ser. No. 11/231,859 entitled "Securing Mechanism for an Image Forming Device Module" filed Sep. 21, 2005, the relevant portions of which are incorporated by reference herein.

Figure 6A:
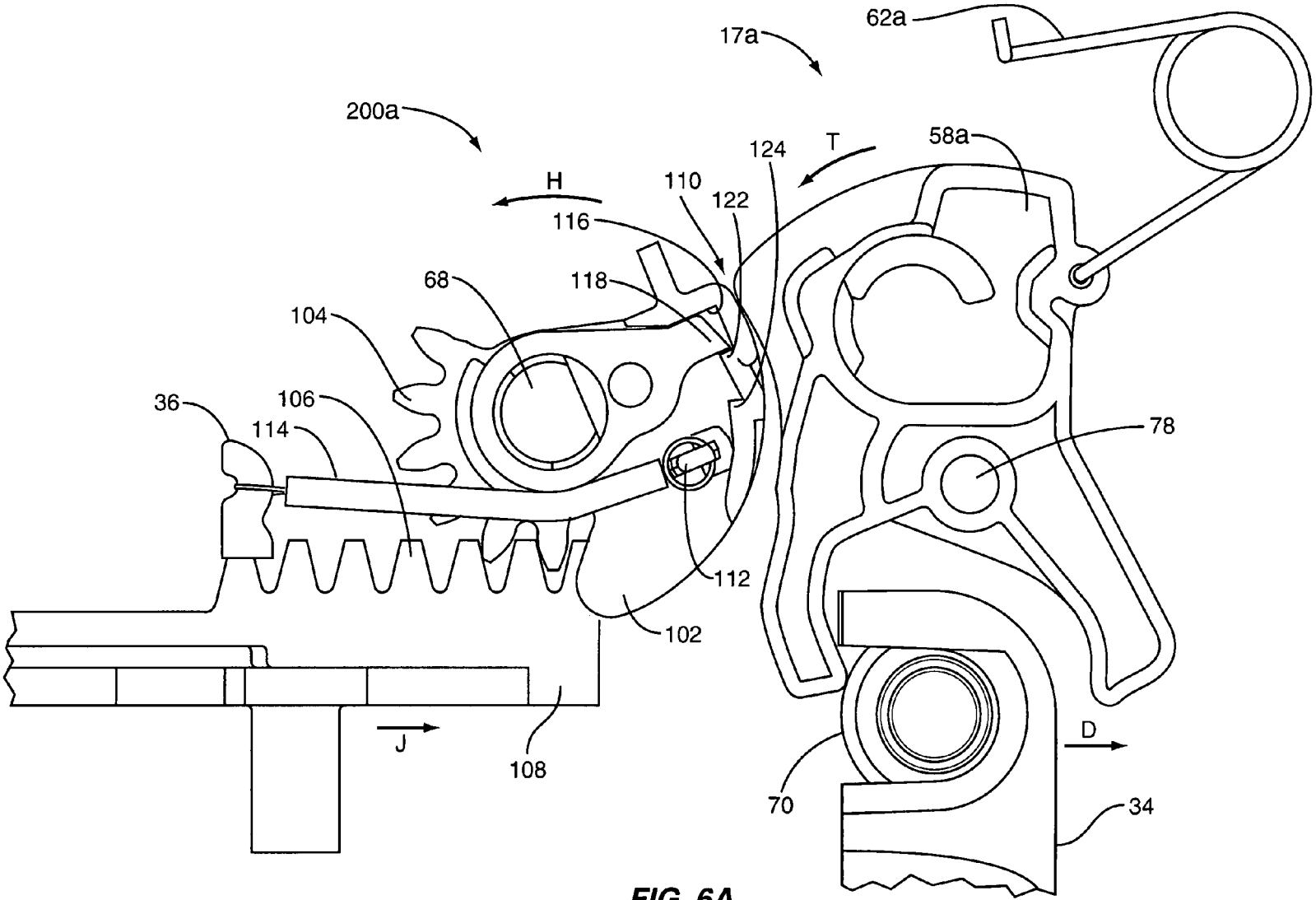
FIGS. 6A-6C are schematic diagrams showing components of a door panel interlock mechanism according to one embodiment of the present invention.

FIG. 6A shows an interlock mechanism 200*a* that works in conjunction with the upper right lock 17*a* to control the order in which the door assemblies 11, 13 are opened and closed. For the sake of generality, the following discussion will presume different configurations for an upper right interlock 200*a* and an upper left interlock 200*c* (not shown in FIGS. 6A-6C, but see FIGS. 10A-10C). However, in at least one alternative implementation, the structure used in the upper right interlock 200*a* may be used in both the right and left sides of the exemplary image forming device 10. However, some advantages to having slightly different configurations for the upper right interlock 200*a* and the upper left interlock 200*c* are discussed in detail below.

The upper right interlock 200*a* includes a pawl 118 that is fixedly attached to the previously described crank shaft 68. A D-shaped opening in the pawl 118 mates with the D-shaped crank shaft 68. Thus, as the first door assembly 11 opens and closes as shown in FIGS. 5A-5C, the pawl 118 also rotates. The pawl 118 fits within a retraction pinion cam 102. In most instances, rotation of the crank shaft 68 and pawl 118 induces rotation of the retraction pinion cam 102. The retraction pinion cam 102 rotates about crank shaft 68 but is not keyed to the crank shaft 68 in the same way the pawl 118 is keyed. Thus, the retraction pinion cam 102 moves through contact between the pawl 118 and surfaces 116 or first or second catches 122, 124. For instance, FIG. 6A shows the condition where the first door assembly 11 and the second door assembly 13 are closed and the image forming device 10 is ready to print. If at this point, the first door assembly 11 is opened, the crank shaft 68 and pawl 118 rotate in a direction indicated by the arrow labeled H. The physical contact between the pawl 118 and surface 116 causes the retraction pinion cam 102 to rotate in the direction of arrow H as well. When the first door assembly 11 is completely open, the crank shaft 68, pawl 118, and retraction pinion cam 102 move to the position shown in FIG. 6B. At this point, the second door assembly 13 remains closed so the upper right lock 17*a* and roller frame 34 remain in the same position as in FIG. 6A.

Motion of the retraction pinion cam 102 is further constrained by an assist spring 114 that is attached to the retraction pinion cam 102 at a first anchor point 112. The assist spring 114 travels around the pawl 118 and connects at a second end to the interior frame 36 of the image forming device 10. As will be discussed below, the retraction pinion cam 102 is only loosely coupled to the crank shaft 68. Thus, the assist spring 114 serves at least two purposes. First, as the first door assembly 11 is closed, the assist spring 114 helps pull the retraction pinion cam 102 back to the closed position shown in FIG. 6A. Second, the assist spring helps maintain contact between pawl 118 and either the first 122 or second 124 catches. Thus, when the pawl 118 rotates between the open position shown in FIG. 6B and the closed position shown in FIG. 6A, the pawl 118 can drive the retraction pinion cam 102 as well.

In the closed orientation shown in FIG. 6A, the retraction pinion cam 102 is oriented so that an interference point 110 exists between the retraction pinion cam 102 and the over-center clamp 58*a*. Thus, if the second door assembly 13 is pulled open as indicated by the arrow labeled D, motion of the over-center clamp 58*a* in the direction of arrow T is impeded at the interference point 110. This interference 110 serves to remind users that the second door assembly 13 should not be opened until the first door assembly 11 is completely open.

Figure 6B:
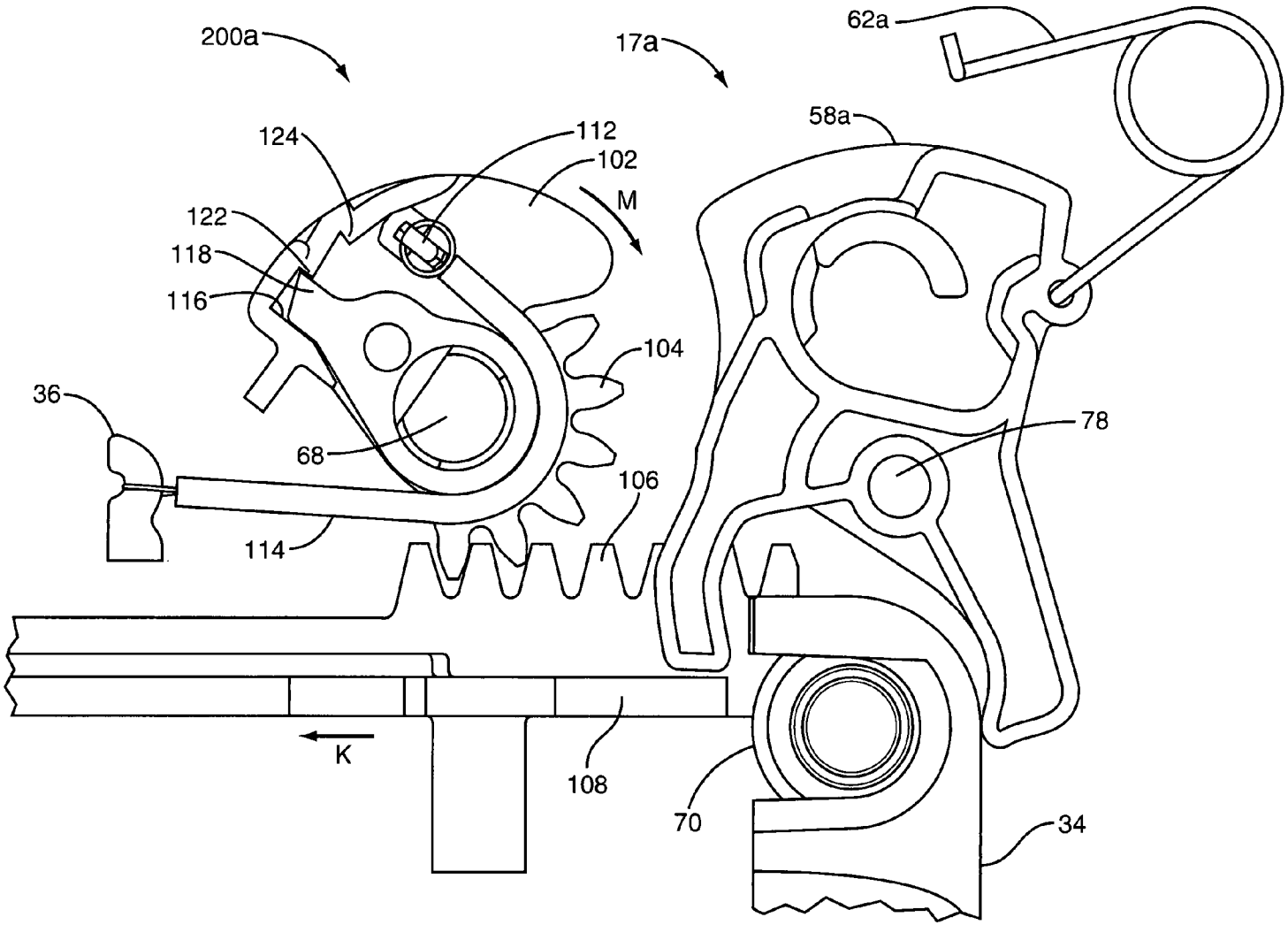

The retraction pinion cam 102 also includes a series of pinion gear teeth 104 disposed opposite from the catches 122, 124. These pinion gear teeth 104 engage mating gear teeth 106 on a retraction rack 108. The respective teeth 104, 106 induce lateral motion of the retraction rack 108 that is dependent upon the motion of the retraction pinion cam 102. Thus, as FIG. 6A shows, when the first door assembly 11 opens and the retraction pinion cam 102 rotates in the direction of arrow H, the retraction rack 108 moves in the direction of arrow J. Similarly, as illustrated in FIG. 6B, when the first door assembly 11 closes and the retraction pinion cam 102 rotates in the direction of arrow M, the retraction rack 108 moves in the direction of arrow K. This lateral motion of the retraction rack 108 induces coupling and de-coupling of a drive train system and electrical motors that are used to apply rotary motion to the four developer members 45, the four photoconductive members 51, and the belt module 20 shown in FIGS. 2 and 3. These drive train components are located within a gearbox (not shown) that is connected to the developer members 45, the four photoconductive members 51, and the belt module 20 by means of axially retractable couplings (also not shown). A thorough description of this coupling mechanism is provided in commonly assigned U.S. patent application Ser. No. 10/810,139 entitled "Coupling Retraction Mechanism for an Image Forming Device" filed Mar. 26, 2004, the relevant portions of which are incorporated by reference herein. It will suffice to say here that the motion of the retraction rack 108 engages and disengages the developer members 45, the four photoconductive members 51, and the belt module 20 so that these components may be removed once the door assemblies 11, 13 are opened. Further, since the roller frame 34 and the rotating belt module 20 are coupled to the second door assembly 13, the releasing action induced by the retraction rack 108 allows users to open the door assembly 13 without damaging drive couplings and drive train components.

Figure 6C:
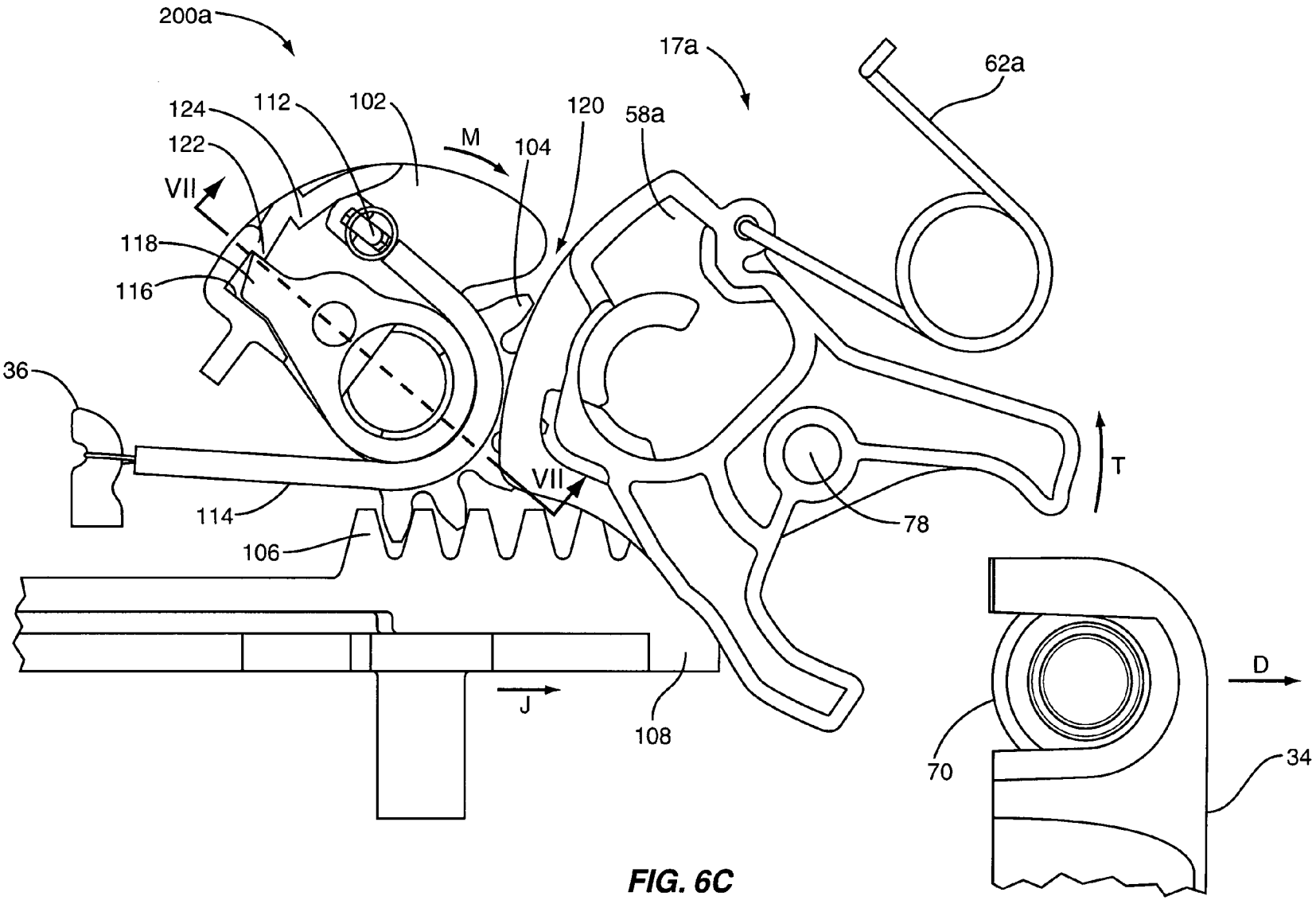

The progression from FIG. 6B to FIG. 6C represents the step of opening the second door assembly 13 after the first door assembly 11 is open. FIG. 6C represents the condition where both door assemblies 11, 13 are open. Opening the second door assembly 13 causes the roller frame 34 to move in the direction of arrow D, which in turn, causes the over-center clamp 58*a* to rotate in the direction of arrow T. At this point, a user may access the internals of the image forming device to clear paper jams or remove consumable CRUs. Once the image forming device 10 has been serviced, the process of closing the door assemblies 11, 13 should follow the reverse order as opening. That is, the second door assembly 13 should be closed before the first door assembly 11. To that end, a second interference point 120 shown in FIG. 6C is created between the retraction pinion cam 102 and the over-center clamp 58*a*. Thus, if a user attempts to close the first door assembly 11, thereby attempting to rotate the pawl 118 and retraction pinion cam 102 in the direction of arrow M, the interference 120 between the retraction pinion cam 102 and the over-center clamp 58*a* may serve as a reminder that the second door assembly 13 should be closed first.

The pivot arms 64, 66 described above (and shown in FIGS. 5A-5C) may offer a substantial amount of mechanical advantage. Thus, it may be possible for a user to force the first door assembly 11 closed despite the resistance offered by interference point 120. Accordingly, a breakaway feature is built into the upper right interlock 200*a*. The section views provided in FIGS. 7A and 7B, identified by the section lines in FIG. 6C, help illustrate this breakaway feature.

Figure 7A:
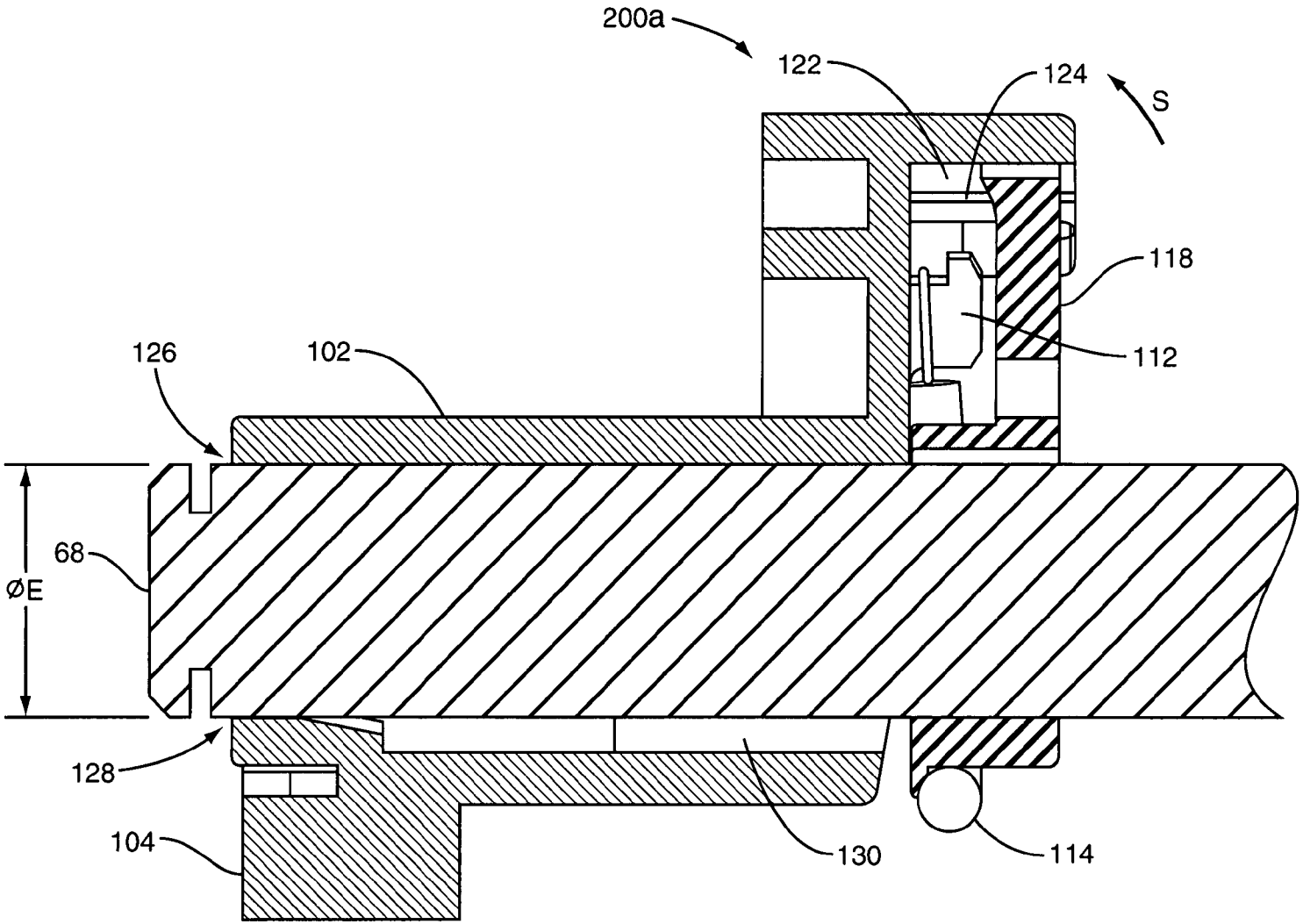
FIGS. 7A-7B are frontal section views illustrating components of a breakaway feature in a door panel interlock mechanism according to one embodiment of the present invention.
Figure 7B:
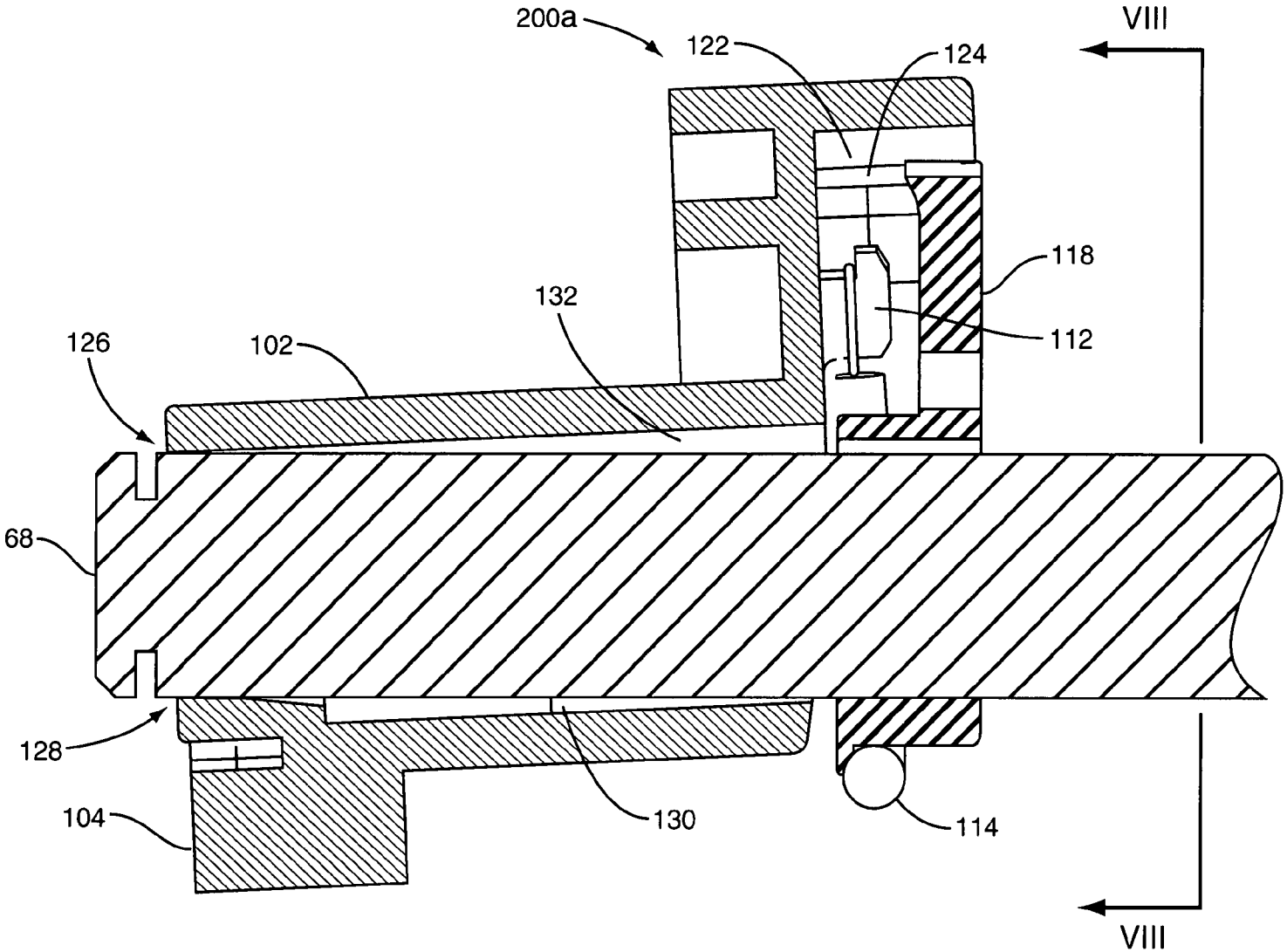

FIGS. 7A and 7B illustrate various components of the upper right interlock 200*a* described above. These include the retraction pinion cam 102, the pawl 118, the assist spring 114, and the crank shaft 68 about which these other components rotate. As discussed above, the retraction pinion cam 102 is not keyed to the crank shaft 68. It was also mentioned that the retraction pinion cam 102 is only loosely coupled to the crank shaft 68. The left side of FIG. 7A shows a diameter dimension ØE reflecting the diameter of the crank shaft 68. At the left side of the retraction pinion cam 102, near the pinion gear teeth 104, there exists a relatively tight fit between the retraction pinion cam 102 and the crank shaft 68 as identified by the lack of an apparent gap at locations 126 and 128. However, towards the right side of the retraction pinion cam 102, nearest the pawl 118, there exists a gap 130 between the crank shaft 68 and the retraction pinion cam 102. This gap 130 permits relative movement, identified by the arrow S, between the retraction pinion cam 102 and the crank shaft 68 and pawl 118. In fact, the representation shown in FIG. 7B illustrates the condition where the retraction pinion cam 102 has moved in the direction of arrow S. This movement results in a reduction in the previously mentioned gap 130 and a formation of a second gap 132 opposite to the first gap 130.

Figure 8:
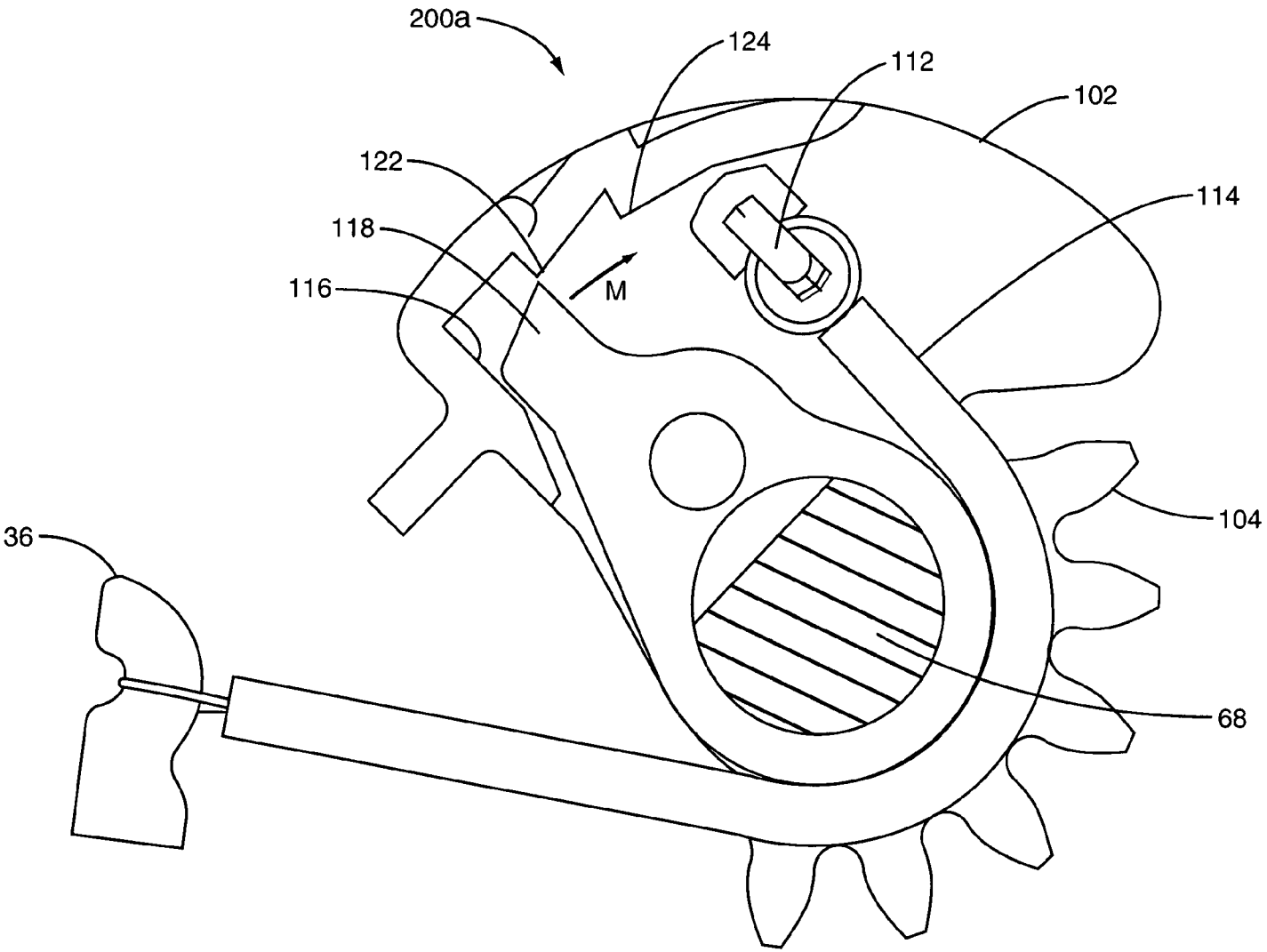
FIGS. 8 is a lateral view illustrating components of a breakaway feature in a door panel interlock mechanism according to one embodiment of the present invention.
Figure 9:
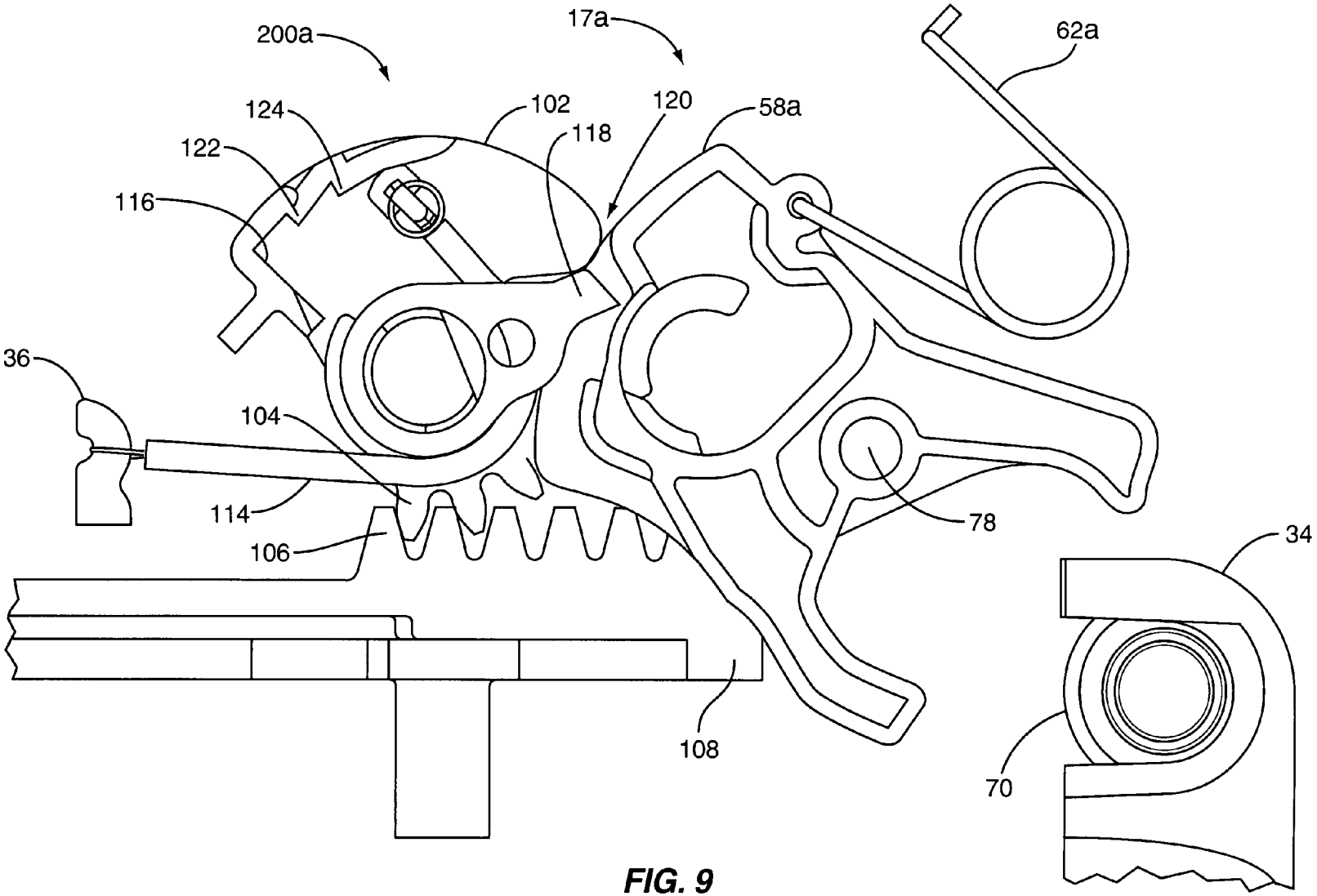
FIGS. 9 is a schematic diagram showing components of a door panel interlock mechanism with a released breakaway feature according to one embodiment of the present invention.

As a result of this rocking motion of the retraction pinion cam 102, the pawl 118 releases from the first catch 122 and second catch 124. This situation is illustrated in FIG. 8, where the pawl 118 begins to slide past the first catch 122 in the direction of arrow M. In actuality, the rocking motion of the retraction pinion cam 102 may be caused when the first door assembly 11 is forced to close while both door assemblies 11, 13 are open. Comparing FIGS. 6C and 9, the retraction pinion cam 102 is restrained from rotating in the direction of arrow M by the interference 120. However, since pawl 118 is keyed to crank shaft 68, the pawl 118 begins to rotate as door assembly 11 closes. The interference between the pawl 118 and the first catch 122 causes the retraction pinion cam 102 to rock in the direction identified by the arrow S in FIG. 7A. Ultimately, if enough of a closing force is applied to close the first door assembly 11, the pawl 118 will break away from the retraction pinion cam 102 and the crank shaft 68 and pawl 118 will move to the position shown in FIG. 9.

Two possible modes of correction are provided to reset this breakaway feature. The first simply consists of re-opening the first door assembly 11 so that the crank shaft 68 and the pawl 118 rotate back from the orientation shown in FIG. 9 towards the orientation shown in FIG. 6A. A second mode of correction is provided by the assist spring 114 in the event the second door assembly 13 is closed enough to cause the over-center crank 58*a* to move out of interference with the retraction pinion cam 102. In this case, the assist spring 114 pulls the retraction pinion cam 102 towards the displaced pawl 118 and forces engagement of either the first catch 122 or second catch 124. Two separate catches 122, 124 are provided to accommodate part size and placement variations caused by manufacturing tolerances. The second catch 124 is positioned to accommodate a worst case tolerance stack up. In cases where resetting the breakaway feature results in the pawl 118 engaging the second catch 124, the pawl 118 will ultimately push up against surface 116 (likely when the first door assembly 11 is next opened) to completely reset the breakaway feature.

Figure 10A:
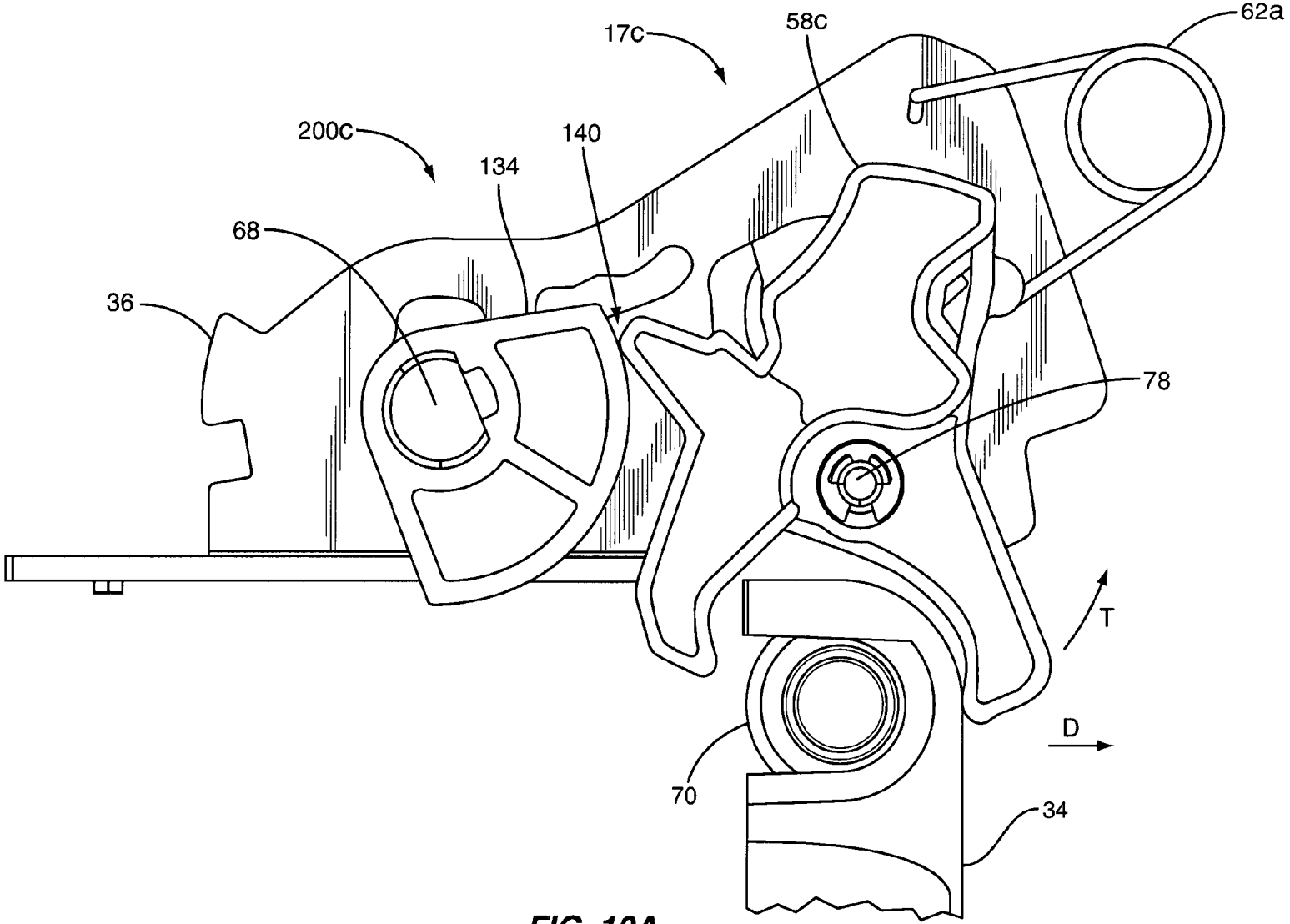
FIGS. 10A-10C are schematic diagrams showing components of a door panel interlock mechanism according to one embodiment of the present invention.
Figure 10B:
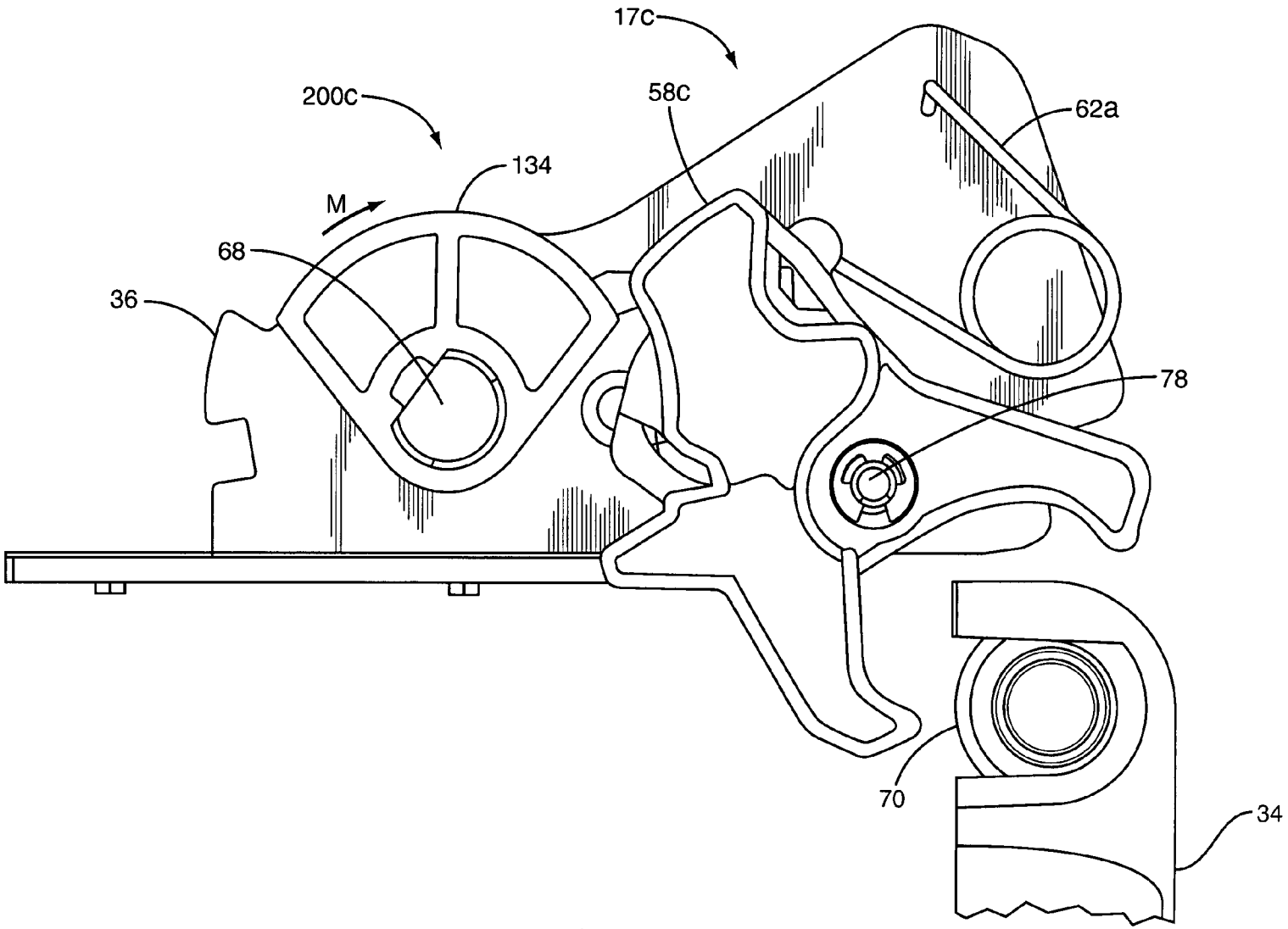
Figure 10C:
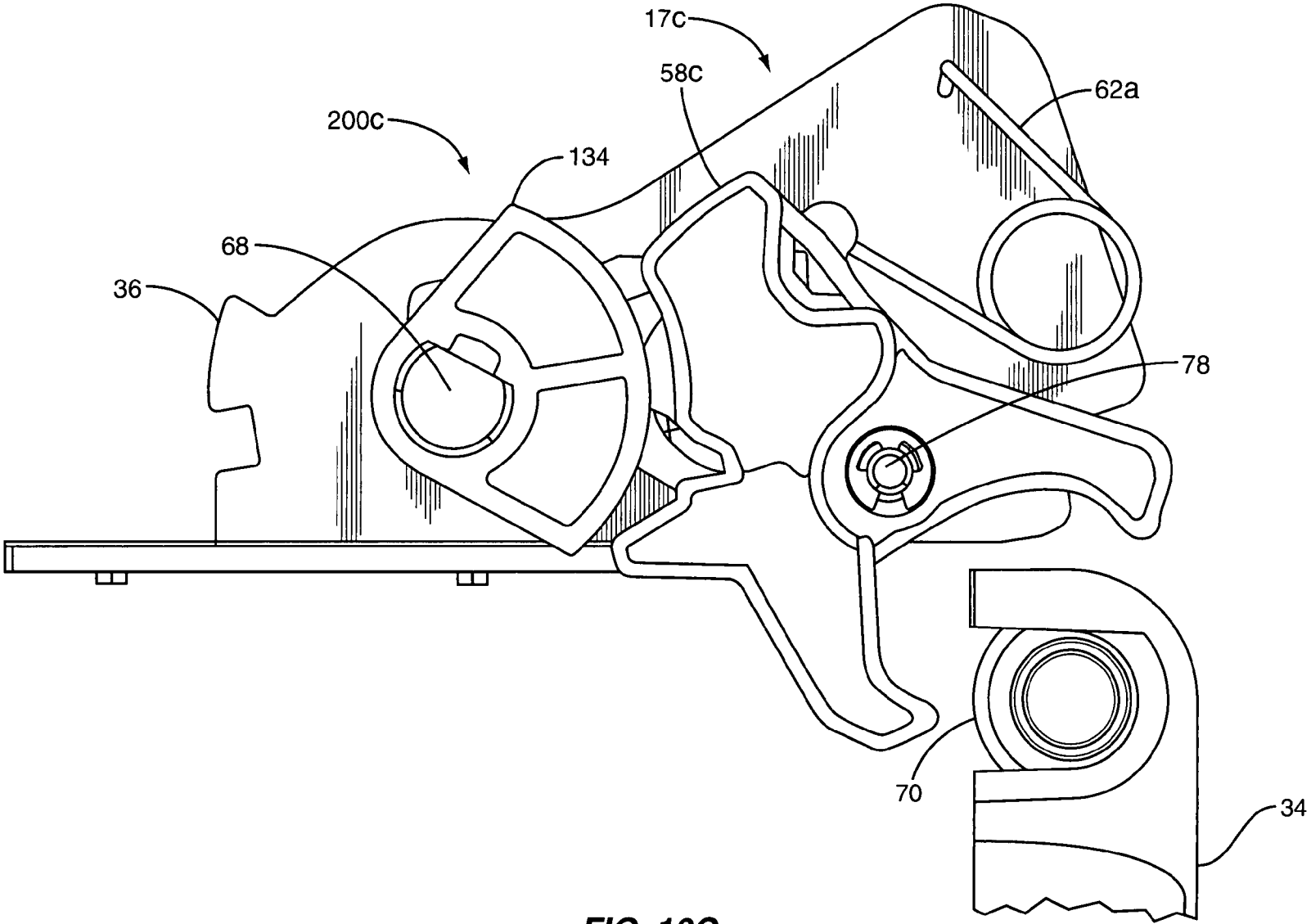

As discussed above, the features of the upper right interlock 200*a* just described may be incorporated at or near the other locks 17*b*, 17*c*, 17*d*. In an alternative embodiment, a modified upper left interlock 200*c* may be incorporated to increase the effectiveness of the breakaway feature of the upper right interlock 200*a*. This modified upper left interlock 200*c* is illustrated in FIGS. 10A-10C. These Figures also illustrate the upper left lock 17*c*, which operates using the same principals discussed above for the upper right lock 17*a*, albeit with an over-center clamp 58*c* having a slightly different configuration.

FIG. 10A illustrates the condition where both door assemblies 11, 13 are closed. In this condition, an interference point 140 exists between the over-center clamp 58*c* and a second retraction cam 134. As opposed to the retraction pinion cam 102, the second retraction cam 134 is keyed to the crank shaft 68 and therefore moves with the crank shaft 68 at all times. The interference 140 between the second retraction cam 134 prevents rotation of the over-center clamp 58*c* in the direction of arrow T. This, in turn, prevents the second door assembly 13 from being pulled open in the direction of arrow D. Thus, both the upper left interlock 200*c* and the upper right interlock 200*a* include similar interference points 120, 140 that prevent users from opening the second door assembly 13 before the first door assembly 11 is opened.

FIG. 10B illustrates the condition where both door assemblies 11, 13 are opened. This condition corresponds to the condition shown in FIG. 6C. Note that once the first door assembly 11 is opened and the crank shaft 68 and second retraction cam 134 move out of the way of the over center clamp 58*c*, the second door assembly 13 may be opened to the position shown in FIG. 10B. In contrast with the upper right interlock 200*a*, the upper left interlock 200*c* does not create a second interference that serves to prevent closing the first door assembly 11 before closing the second door assembly 13. Instead, the second retraction cam 134 is actually configured so that it clears the over-center clamp 58*c* if forced to move in the direction of arrow M when the first door assembly 11 is forced closed. This clearance between the second retraction cam 134 and the over-center clamp 58*c* is shown in FIG. 10C, which represents the condition where the second door assembly 13 is open and the first door assembly 11 is closed. This clearance in the upper left interlock 200*c* may contribute to the effectiveness of breakaway feature in the upper right interlock 200*a* described above.

Figure 11A:
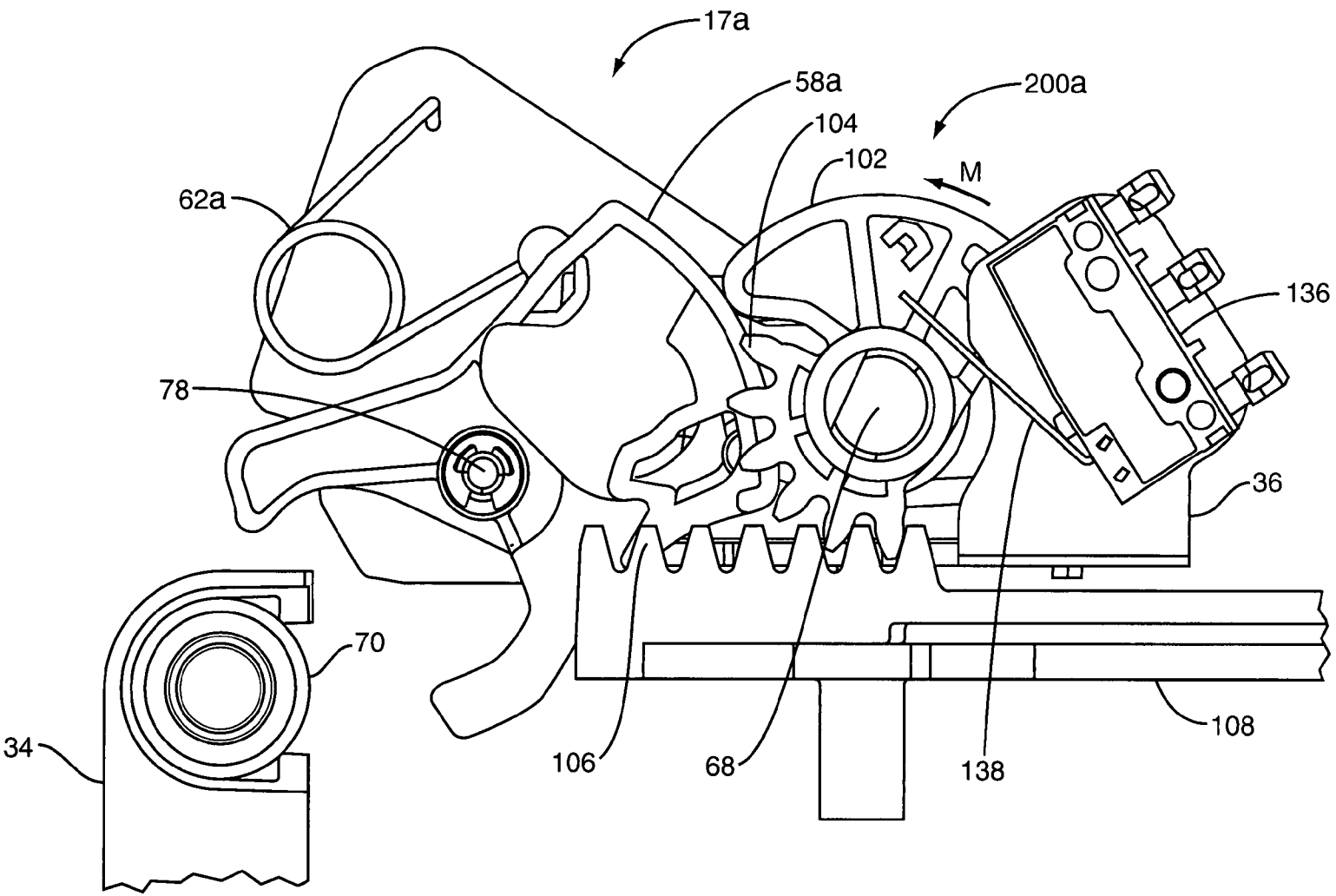
FIGS. 11A-11B are schematic diagrams showing components of a door panel interlock mechanism actuating an electrical interlock according to one embodiment of the present invention.
Figure 11B:
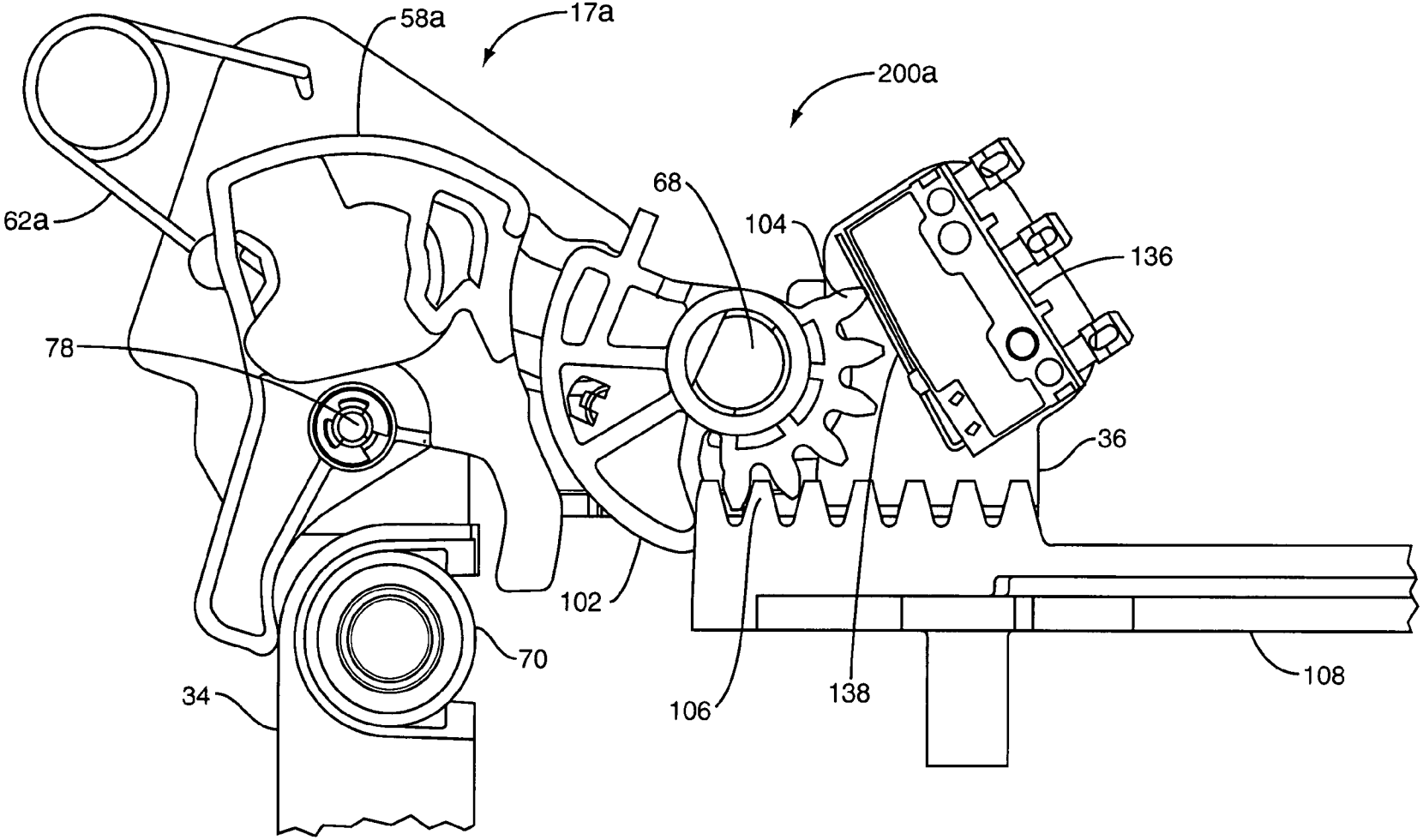

FIGS. 11A and 11B illustrates an electrical interlock switch 136 that is actuated by the motion of the retraction pinion cam 102. The electrical interlock switch 136 is a safety feature that removes power from the image forming device 10 to prevent device operation or electrical shock when the first door assembly 11 is open. Specifically, FIGS. 11A and 11B illustrate the upper right lock 17*a* and upper right interlock 200*a* from a direction reverse to that provided in FIGS. 6A-6C and 9. As described previously, the retraction pinion cam 102 includes a series of pinion gear teeth 104. Notably, the pinion gear teeth 104 do not span a full circumference around the axis of rotation, which happens to be the crank shaft 68. As such, the pinion gear teeth 104 provide an eccentric feature that may be used to trip a lever arm 138 on the electrical interlock switch 136. This is illustrated in FIG. 11B, where the door assemblies 11, 13 are closed as compared to the open state shown in FIG. 11A. In FIG. 11A, the pinion gear teeth 104 are rotated away from the switch lever 138. In this position, the electrical interlock switch 136 is open and power is removed from the image forming device 10. The arrow M shown in FIG. 11A indicates the direction of rotation of the retraction pinion cam 102, and the pinion gear teeth 104, when the first door assembly 11 is closed. Once closed, the pinion gear teeth 104 engage the switch lever 138, thereby closing the electrical interlock switch 136 and reapplying power to the image forming device 10.

The electrical interlock switch 136 is actuated by the motion of the retraction pinion cam 102 and not by the motion of the crank shaft 68 or the pawl 118. Thus, power should not be reapplied to the image forming device 10 if the breakaway feature in the upper right interlock 200*a* is tripped when the first door assembly 11 is inadvertently closed before closing the second door assembly 13. Note that in FIG. 9, which shows the tripped breakaway feature of the upper right interlock 200*a*, the retraction pinion cam 102 remains in the "open" position due to interference 120. Therefore, the electrical interlock 136 also remains open.

The present invention may be carried out in other specific ways than those herein set forth without departing from the scope and essential characteristics of the invention. For example, embodiments of the mechanical interlocks 200*a*, 200*c* and electrical interlock 136 have been described according to their position in the exemplary image forming device 10. Thus, the terms upper right, upper left, lower right, and lower left have been included merely for clarity in the detailed description. The features described herein may be implemented in any appropriate location depending on the device configuration as well as the configuration of door panels in the device. The present embodiments are, therefore, to be considered in all respects as illustrative and not restrictive, and all changes coming within the meaning and equivalency range of the appended claims are intended to be embraced therein.

What is claimed is:

1. An image forming device comprising:

a body;

a photoconductive member;

a first door assembly movably coupled to the body and positionable between a first open orientation positioned away from the body and a first closed orientation positioned in proximity to the body;

a first interlock to prevent a door assembly motion, the door assembly motion being when the door assembly moves under the influence of a force from the first open orientation to the first closed orientation unless a condition is satisfied;

a breakaway feature to release the first interlock when the force exceeds a predetermined level; and a second interlock to unconditionally allow the door assembly motion.

2. The image forming device of claim 1 wherein the condition comprises a second door assembly being positioned in a second closed orientation in proximity to the body.

3. The image forming device of claim 2 wherein the first interlock and the second interlock obstruct the second door assembly from moving from the second closed orientation to a second open orientation away from the body if the first door assembly is not in the first open orientation.

4. The image forming device of claim 2 wherein the breakaway feature resets the first interlock if the second door assembly is moved from a second open orientation away from the body to the second closed orientation.

5. The image forming device of claim 1 further comprising an electrical interlock to disconnect power to the image forming device when the first door assembly is positioned in the first open orientation.

6. The image forming device of claim 5 wherein the electrical interlock continues to remove power if the breakaway feature has released the first interlock.

7. The image forming device of claim 5 wherein the electrical interlock supplies power to the image forming device when the first door assembly is positioned in the first closed orientation.

8. The image forming device of claim 1 wherein the breakaway feature resets the first interlock if the door assembly is moved from the first closed orientation to the first open orientation.

9. The image forming device of claim 2 further comprising an image forming device module coupled to the second door assembly.

10. An image forming device comprising:

a body;

an photoconductive member;

a first door assembly movably coupled to the body and positionable between a first open orientation positioned away from the body and a first closed orientation positioned in proximity to the body;

a second door assembly movably coupled to the body and positionable between a second open orientation positioned away from the body and a second closed orientation positioned in proximity to the body;

a first interlock to prevent a first door assembly motion and to prevent a second door assembly motion, the first door assembly motion being when the second door assembly moves from the second closed orientation towards the second open orientation prior to moving the first door assembly from the first closed orientation to the first open orientation, the second door assembly motion being when the first door assembly moves between the first open orientation and the first closed orientation prior to moving the second door assembly from the second open orientation to the second closed orientation; and a second interlock to prevent the first door assembly motion and allow the second door assembly motion.

11. The image forming device of claim 10 further comprising an image forming device module coupled to the second door assembly.

12. The image forming device of claim 10 further comprising an electrical interlock to disconnect power to the image forming device when the first door assembly is positioned in the first open orientation.

13. The image forming device of claim 10 further comprising a breakaway feature in the first interlock to release the interlock and allow the second door assembly motion under the influence of a predetermined force.

14. The image forming device of claim 13 further comprising an electrical interlock to supply power to the image forming device when the first door assembly is positioned in the first closed orientation unless the breakaway feature has released the interlock.

15. A method of interlocking door assembly movements in an image forming device, the method comprising:

obstructing a first motion of a first door assembly at a plurality of interlocks when a second door assembly is in a first predetermined state;

removing power from the image forming device and obstructing a motion of the second door assembly at one of the plurality of interlocks when the first door assembly is in a second predetermined state; and releasing the one of the plurality of interlocks to allow the motion of the second door assembly under the influence of a predetermined force.

16. The method of claim 15 wherein releasing the one of the plurality of interlocks to allow the motion of the second door assembly under the influence of a predetermined force comprises further removing power from the image forming device.

17. The method of claim 15 wherein the first predetermined state is when the second door assembly is closed.

18. The method of claim 15 wherein the second predetermined state is when the first door assembly is open.

19. The method of claim 15 further comprising removing an obstruction to the motion of the second door assembly at the one of the plurality of interlocks when the first door assembly is in a third predetermined state.

20. The method of claim 19 further comprising reapplying power to the image forming device when the second door assembly completes the motion.

21. The method of claim 19 wherein the third predetermined state is when the first door assembly is open.

* * * * *